United States Patent [19]

Paul

[11] Patent Number: 4,781,556

[45] Date of Patent: Nov. 1, 1988

[54] GROUTING MACHINE

[76] Inventor: Jesse D. Paul, 501 Vassar St., SE., Albuquerque, N. Mex. 87106

[21] Appl. No.: 23,770

[22] Filed: Mar. 9, 1987

Related U.S. Application Data

[63] Continuation-in-part of Ser. No. 751,966, Jul. 5, 1985, abandoned.

[51] Int. Cl.[4] ..... B29C 39/00; E01C 23/02

[52] U.S. Cl. ..... 425/62; 404/87; 404/107; 425/87; 425/90; 425/216; 425/456

[58] Field of Search ..... 425/62, 87, 215, 216, 425/218, 219, 110, 90, 94, 103, 458, 456; 264/261, 261 X; 401/13; 404/83, 85, 87, 91, 96, 97, 101, 103, 105, 107, 108, 112, 117, 118, 129

[56] References Cited

U.S. PATENT DOCUMENTS

| | | | |
|---|---|---|---|
| 145,459 | 12/1873 | Stevens et al. | 425/458 |
| 870,454 | 11/1908 | McCabe et al. | 15/52 |
| 977,701 | 12/1910 | Broberg | 15/52 |
| 1,176,990 | 3/1916 | Scherff et al. | 15/52 |
| 2,530,777 | 11/1950 | Middlestadt | 404/107 |
| 2,578,080 | 12/1951 | Middlestadt | 404/107 |
| 2,709,267 | 5/1955 | Williams | 15/50 C |
| 3,130,652 | 4/1964 | Newton et al. | 15/50 R |
| 3,246,583 | 4/1966 | Schiller | 404/87 |
| 3,321,331 | 5/1967 | McNeely | 15/50 R |
| 3,799,714 | 3/1974 | Vetovitz | 425/62 |
| 4,043,487 | 8/1977 | Price | 425/62 |

*Primary Examiner*—Willard Hoag
*Attorney, Agent, or Firm*—Gary L. Jordan

[57] ABSTRACT

A grouting machine which has a grout dispensing means for depositing grout between prepositioned floor tiles and on the upper surfaces of the tiles and which contains a grout removal means for removing excess grout from the upper surfaces of the tiles. The remaining grout fills the spaces between the sides of the tiles. The grout removal means includes at least one pick-up assembly. An air conducting system is used for moving the remaining grout slurry to a storage tank by operation of a vacuum source. A diluent addition means is provided for use in the slurry formation means when needed.

An application means is provided to assure the uniform deposit of grout into the cracks between the prepositioned tiles. A drive motor, vacuum pump and diluent pump are provided on the grouting machine for operation of the various means. The grouting machine and method for operating the same are disclosed.

70 Claims, 11 Drawing Sheets

20
22
24
26
28
30
36
38
40
44
46
48
54
58
60
62
64
66
70
72
74
75
76
78
80
82
86
88
90
92
94
96
98
100
102
104
106
108
114
116
120
124
128
132
134
136
138
139
140a
140b
141
142
143
144
145
146
148
150
152
154
156
158
159
160
162
165
166
168
170
172
174
176
178
180
182
184
185
188
192
194
196
198
200
202
204
206
208
210
224
240
242
248
250
254
258
260
262
266
270
272
274
276
328
330
344
348
350
352
354
356
358
360
362

FIG. 20
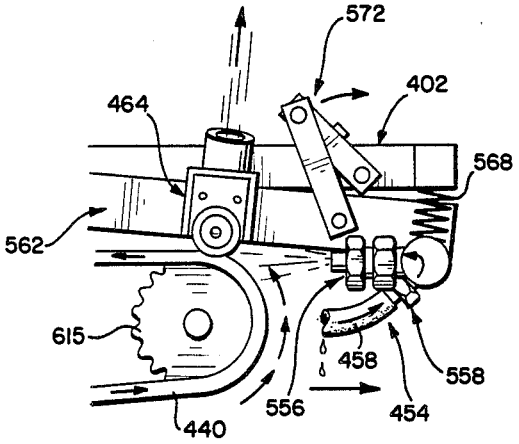
FIG. 21
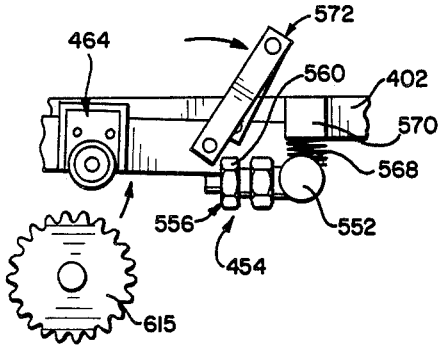
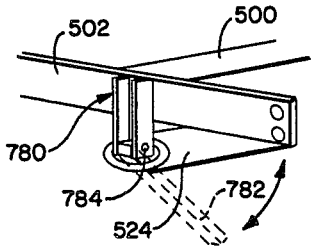
FIG. 24
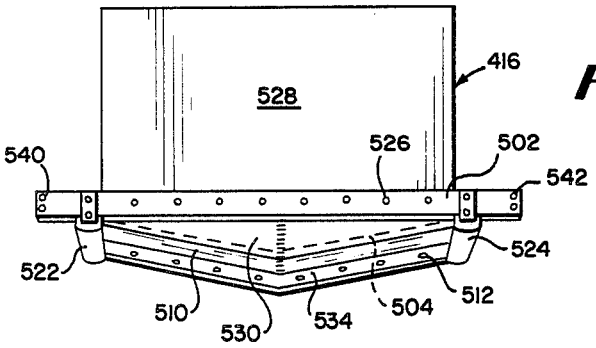
FIG. 23
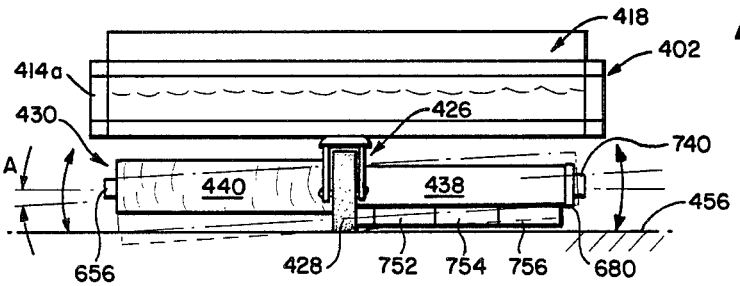
FIG. 22

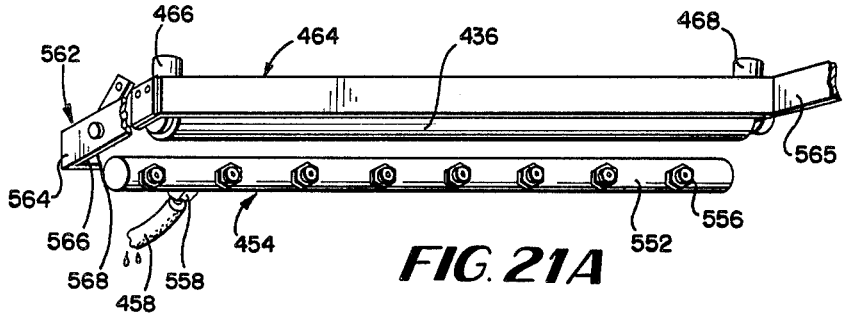
FIG. 21A
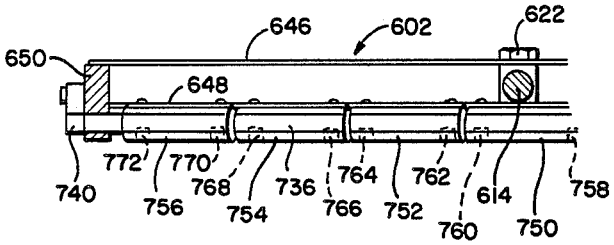
FIG. 29
FIG. 30
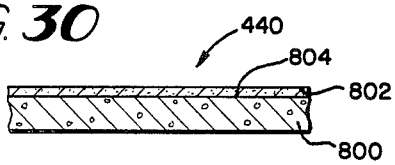

GROUTING MACHINE

This is a continuation-in-part of application Ser. No. 751,966, filed July 5, 1985, now abandoned.

BACKGROUND OF THE INVENTION

The present invention relates to a grouting machine for use in depositing grout between a series of pre-positioned floor tiles and for removing excess grout from the upper surfaces of the tiles in order to finish the laying of a tile floor.

Grout is a mixture of particulate material such as plaster or other desiccated inorganic minerals and water. Plaster of Paris for example is dehydrated gypsum which when mixed with water evolves heat, quickly solidifies, and expands slightly. Such mixtures can be employed for providing the grout between prepositioned tiles in order to form a hard water resistant surface for such tiles. A similar technique can be employed with these materials for finishing large areas which are to be covered by large sized tiles. In this application the grout for plaster is used for filling the cracks between the large area tiles.

The dominant method of filling the cracks between the tiles or between larger areas such as presented by wall board sheeting is to lay in the grout with a hand trowel tool. This method is also used for patching masonry walls and plastered walls. Heretofore, there has been no mechanized means for placing the grout in the cracks and removing any excess grout which may be spread by a depositing device.

A machine for grouting prepositioned tiles would have great utility in finishing the large floor areas now being used in high density public areas such as shopping malls, building foyers, and underground passageways.

Machinery for laying down grouting materials in the cracks between pavement slabs has of course been evolved. U.S. Pat. No. 3,130,652 to Newton et al shows such a machine but this machine is not designed to remove any excess grout since none was contemplated. This machine was not designed for use with positioned floor tiles.

U.S. Pat. No. 145,459 to Stevens and Watson shows a plastering machine which is adapted for broad area plastering but not for the plastering of cracks. U.S. Pat. No. 1,795,660 to Mayer shows a street marking machine which lays down a marking material but does not provide for the removal of any of the material so deposited.

U.S. Pat. No. 2,818,790 shows a curb and gutter laying machine which does not provide a grout removal means. There is no disclosure of removing part of the curb or gutter once formed in situ.

Various floor care machines have been presented which deposit either a cleaning solution or wax or other surface protecting materials. U.S. Pat. No. 3,321,331 to McNeely shows a bowling-lane maintenance machine which deposits a lane dressing compound but does not provide for the removal of any of the deposited material.

Also involved with the floor care type of machines are various scrubbing and polishing machines such as shown by U.S. Pat. No. 1,176,990 to Scherff et al. The scrubbing machine shown by this patent does not provide for the depositing of any grout material. The excess water from the scrubbing operation is taken up by a mopping roller 34 which requires the water to be drawn through a sponge rolled into a vacuumed take up core. This type of take-up device is of course inoperative for handling grout slurries due to their thick consistency. The particular matter would quickly clog the take-up mopping roller and render it inoperative.

The floor care type of cleaning machines do not provide for the depositing of grouting material and thus are not concerned with the removal of excess grout which contains a high particular matter content. Rather simple take up brushes and rollers or vacuum pickup lines can thus be used because of the low density of the fluid being taken up. Representative U.S. Pat. Nos. are: 3,869,749 to London et al which shows a dirt and water vacuum pickup apparatus for escalators; 977,701 to Broberg which shows a rotating mopping roller; U.S. Pat. No. 870,454 to McCabe et al which shows a pressed sponge roller arrangement for taking up the dirty water; U.S. Pat. No. 3,344,453 to Price which shows a high speed revolution brush for throwing the dirt and water up onto an overhead collector surface 21 for retaining the dirt taken up from the floor. This latter type of apparatus could not be used for a thick grout slurry.

U.S. Pat. No. 2,709,269 to Williams shows a floor sweeper which also has a flailing type brush used with a collector pan.

U.S. Pat. No. 3,359,354 to Johnson discloses a method of producing tile panels in which there is no provision of a removal means adapted for removing excess grout from tile surfaces.

The prior art has not provided a machine which has the capability of both laying down a grout material into the cracks between positioned floor tile and for then removing excess grout from the upper surfaces of the tiles. Such a machine would have a number of advantages in that the laborious task of hand troweling grout between the tile cracks could be drastically reduced. More consistent group application and stronger and longer lasting tile joints would be possible at the same time. Such a machine would result in the savings of grout because a large percentage of the applied grout in the hand-troweling process is discarded as the tile artisan fills and smooths out the grout from around the individual tiles.

Another important aspect of such a tile grouting machine is that the tile laying process could be carried out at lower cost and would therefore be more competitive with respect to other types of floor surfaces which are less attractive and less wear resistant but do not require the use of grouting.

SUMMARY OF THE INVENTION

The grouting machine of the present invention provides a grout dispensing means which is adapted for depositing grout between positioned floor tiles and on the tile upper surfaces and also provides a removal means which is adapted for removing the excess grout from the upper surfaces of the tiles. Since the grout to be placed into the cracks between the positioned tile is a semi-solid paste material, it has been found effective to provide a diluent addition means for use in conjunction with the removal means. The diluent addition means permits the formation of a grout slurried which is somewhat less dense and is thus easier to remove from the upper surfaces of the tiles.

The pickup means which provides for grout removal is formed by at least one take-up assembly which includes a grout intake manifold which is connected to a vacuum source for conducting the grout slurry away from the intake manifold and into a holding tank. The take-up assembly is driven by a drive motor.

The removed grout can be stored in the holding tank and periodically dumped. If desired, a slurry separation system can be provided within the grout machine for separating the excess diluent from the slurry. The diluent in most cases will be water which can then be recycled for use in the diluent addition means in order to form a grout slurry. Preferably, the diluent water can be stored in a water tank and periodically replenished.

The grout dispensing means can preferably have a paddle wheel applicator means in order to more evenly deposit the grout into the cracks between the prepositioned tiles as well as a wiper means for removing excess grout from the upper surfaces of the tiles. The wiper means is positioned to contact the tiles prior to the take-up assembly. Also a vibrator means can be provided for use in conjunction with the grout dispensing means.

At least one pickup assembly is used to provide for grout removal. The diluent addition means is used in conjunction with the pick-up assembly to form a lower density grout slurry by supplying diluent to the group either before or after it is contacted by the pickup assembly. The grout slurry once formed is removed from the pick-up assembly by a grout intake manifold.

It is also possible to utilize two slurry pick-up assemblies in order assure that the slurry once formed is removed from the upper tile surfaces. Both of the pick-up assemblies can then be equipped with slurry intake manifolds connected via a vacuum line to a slurry holding tank. The grouting machine is also provided with a mounting frame and front, intermediate, and rear caster wheels.

The machine is powered by a drive motor which drives the pick-up assemblies and which operates the group dispensing means. The machine is also fitted with a vacuum motor and can be supplied with a water pump for conducting water to the diluent addition means. A pull handle is also provided and is pivotally attached to the machine frame for moving the grouting machine forward over the floor area to be grouted.

The grout dispensing means of the grouting machine is provided with a grout storage means or hopper into which the grout is placed for distribution onto and between the tiles.

In preparation for grouting, the individual tiles are positioned onto an underlying surface such as a cement floor and are secured thereto in the desired pattern, ie. prepositioned. The grouting machine is then loaded with a charge of grout which can have varying consistencies or densities. For some applications grout is utilized in a low liquid/heavy paste formulation which tends to be highly abrasive. An initial charge of water for use in the diluent addition means is also placed into the machine.

It is also possible to utilize the machine as described and claimed for nonaqueous diluents such as alcohol and acetone when non-watersoluble grout materials are to be employed. Various additional safety precautions such as the employment of sealed motors are then used in the grouting machine.

The grouting machine thus charged with the grout and start up water is moved into position over the top of the tiles and the grout is deposited on the tile surfaces and between the cracks of the positioned tiles. The machine is moved forward by pulling the handle. A wiper system then immediately removes excess grout from the upper surfaces of the tile leaving only the grout in the cracks between the tiles and a thin layer on the tile upper surfaces. Next, the start up water is sprayed through the diluent addition means either on the pick-up assembly and/or onto the upper surface of the grout layer remaining on the tile upper surfaces in order to form a slurry of the grout. In the preferred embodiment the diluent water is sprayed mainly onto a sponge belt which is power driven against the upper time surfaces. The diluent water then forms a slurry of the grout on the belt surface and provides water for retention by the sponge belt. The grout intake manifold then removes the grout slurry from the sponge belt and the slurry is transported to the holding tank.

In a second embodiment the diluent is sprayed mainly onto the grout layer on the tile upper surfaces and the first of the two slurry pickup assemblies contacts the slurry layer and a take-up roller wipes the slurry from the floor and up to a perforated slurry intake tube which is positioned with an axis parallel to the axis of the take-up roller.

In the first slurry pickup assembly a drive roller is in frictional contact with the take-up roller which has a thick sponge outer layer and thus drives the take-up roller in a direction opposite to the direction in which the grouting machine is being pulled. The take-up roller is in turn in frictional contact with the perforated slurry intake tube which is then rotated so that the rows of perforations come into contact with the slurry which is pressed from the take-up roller by the slurry intake tube and by the drive roller. This squeezing or "wringer-type" action results in a high slurry concentration along two sides of the slurry intake tube.

After the first slurry pickup assembly has passed over the tile upper surfaces, a second similar slurry pick-up assembly moves over the tile surfaces to provide a final pickup function for any remaining slurry. If desired, additional diluent can be laid down on the remaining slurry layer just prior to the second pickup assembly.

The slurry which is taken up by the pickup assemblies is conducted by a vacuum line into a holding tank. If desired the water can be permitted to separate from the grout and can be then filtered out of and removed from the holding tank by a manner the water which was initially charged into the grouting machine can be recycled and utilized by the slurry formation means to add sufficient liquid to the grout layer so that it can be removed from the upper surfaces of the tile.

It is therefore, an object of the present invention to provide a grouting machine which dispenses grout between prepositioned tile sides and then removes excess grout from the upper surfaces of the tiles.

Another objective of the present invention is to provide a slurry formation means which supplies a grout diluent to the pick-up assembly and/or to the relatively thin layer of grout remaining on the tile upper surfaces in order to form a grout slurry.

Yet another object of the present invention is to provide a slurry pick-up means for use in a grouting machine in which at least one take-up belt or roller and an associated slurry intake manifold are provided for slurry removal.

Another object of the present invention is to provide a grouting machine in which excess grout deposited on the upper surfaces of the tiles is removed by at least one pick-up assembly.

Yet another object of the present invention is to provide a method for dispensing grout onto positioned tiles for grouting the cracks between the tiles and then for picking up the excess grout from the tiles upper surfaces.

These and other objects of the present invention will be apparent from the following descriptions of the drawings.

BRIEF DESCRIPTION OF THE DRAWINGS

FIG. 17 is a partial cut away view of the grout hopper showing the paddle wheel arranged there in;

FIG. 20 is a fragmentary view of the belt drive gear and grout intake manifold showing the diluent addition means and connecting parts;

FIG. 21 is a view corresponding to FIG. 20 where in the intake manifold support arm has been moved upwardly and the grout removal belt has been removed;

FIG. 21A is another view of the grout intake manifold and the diluent addition means shown in FIG. 21;

FIG. 22 is a rear view of the lower portion of the grout removal machine shown in FIG. 14;

FIG. 23 is a front bottom perspective view of the grout hopper of FIG. 14 showing the floor gasket and main wiper structure;

FIG. 24 is a view of the floor gasket retaining bracket;

FIG. 29 shows a front plan view of a portion of the rear part of the grout pick-up assembly showing the belt depressor mechanism taken on line 29—29 on FIG. 28; and FIG. 30 is a cross sectional view of a portion of the grout removal belt of the machine shown in FIG. 14.

DETAILED DESCRIPTION OF THE INVENTION

Figure 5:
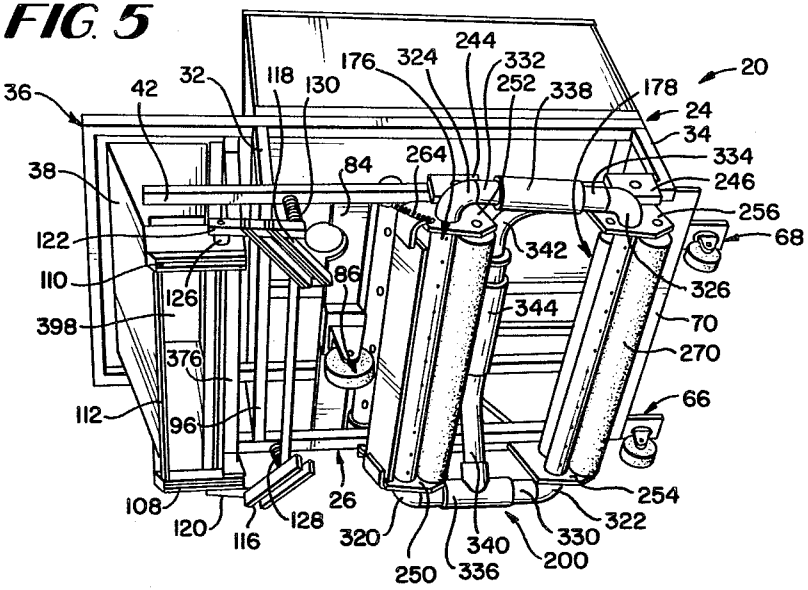
FIG. 5 is a bottom perspective view of the machine with the front casters removed.
Figure 6:
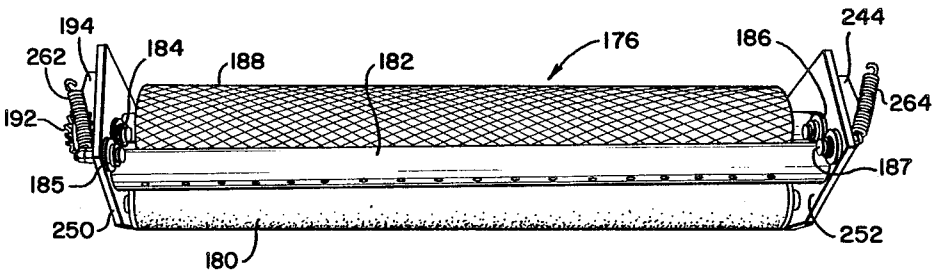
FIG. 6 is a detail perspective view of one of the slurry pick-up assemblies.

As shown in FIGS. 1–12 a first modification of the grouting machine 20 has a frame 22 which consists of an upper generally rectangular horizontally disposed frame 24 and a lower rectangularly shaped frame or support means 26 separated by four vertical supports 28, 30, 32 and 34 (as seen in FIG. 5). The upper rectangular frame 24 has a front grouting dispenser extension 36 which provides an upper frame for the grout hopper 38. The lower frame 26 is extended by two side extensions 40 and 42 in order to support front vertical frame members 44 and a corresponding member which connects to extension 42 (removed from FIG. 5 for clarity).

A bifurcated pull handle 46 is connected by first and second pivotal connections 48 and 50 to the front upper transverse frame member 52 which extends between the side frame members 54 and 56 of the upper rectangular frame extension 36. A similar lower transverse member (removed for clarity) connects the bottom ends of the front vertical frame members 40 and 42.

Figure 1:
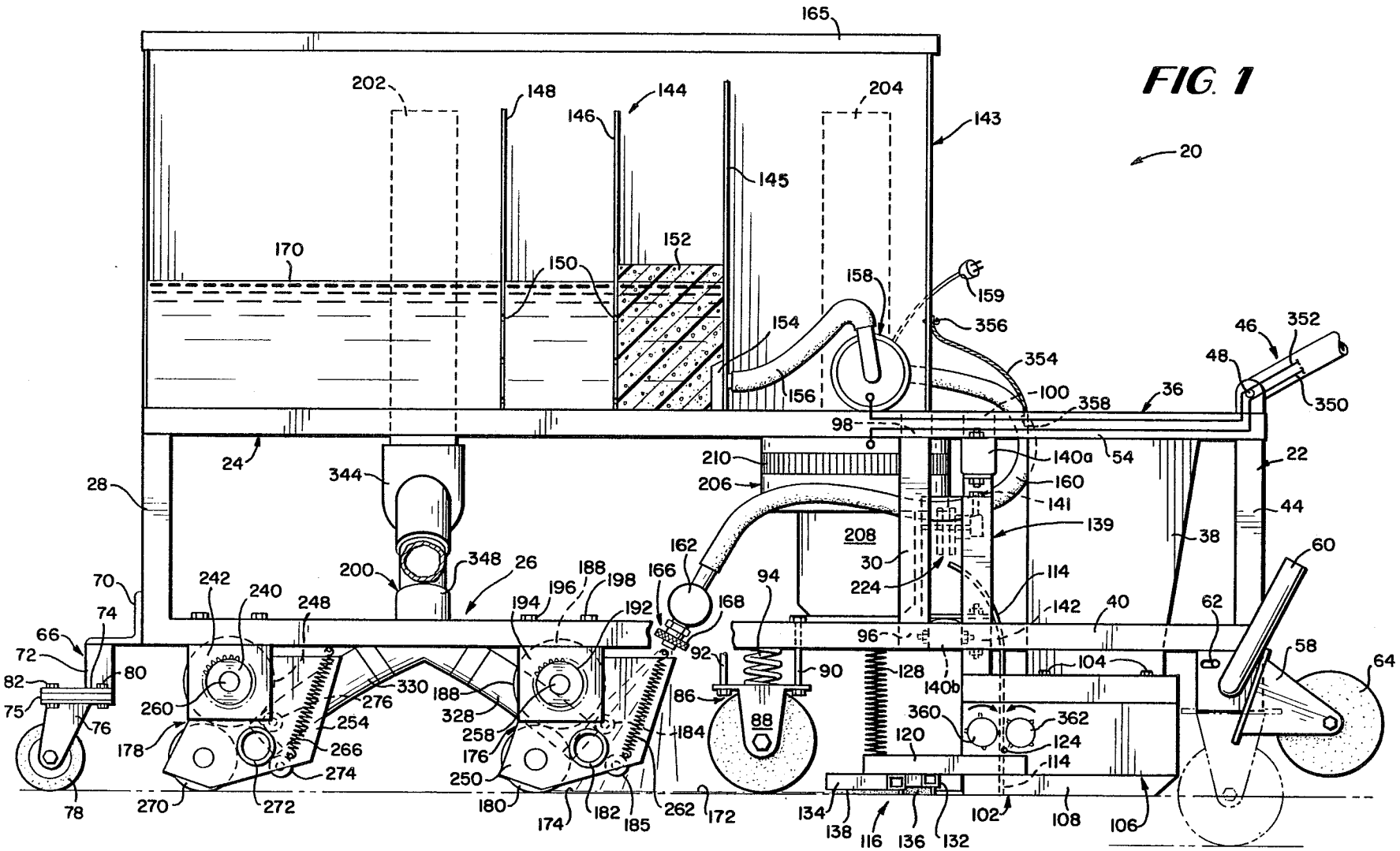
FIG. 1 is a side elevation schematic view of the grouting machine of the present invention.

Pivotal front wheel sets illustrated by front wheel set 58 in FIG. 1 are provided for both of the lower front extension frame corners. These wheel sets are pivotable by handles such as handle 60 and are secured in the vertical supporting position by a pin catch 62. The casters 64 are thus designed to remain out of contact with the prepositioned tiles during operation of the grouting machine 20 as shown in solid lines or to be utilized for positioning and moving the machine between work locations when lowered into the vertical position as shown by phantom lines.

Rear wheel sets 66 and 68 are provided on the lower rear corners of the two level machine frame 22. These wheel sets are connected by an angle frame member 70 to which a support bracket 72 is in turn connected. A horizontally attached support bracket member 74 is then provided for attachment to the caster support 76 which provides the pivotable support for a caster wheel 78 as shown for the wheel assembly 66. The caster support 76 is connected by attachment bolts 80 and 82 to the support bracket member 74 whereby a slight vertical adjustment by means of a spacer member 75 is provided for. Both of the wheel sets 66 and 68 have the described construction.

The lower rectangular frame member 26 has a transverse support member 84 positioned thereacross as seen in FIG. 5. A centrally disposed suspension mounted caster wheel assembly 86 is provided on the bottom side of this transverse frame member. The caster wheel support 88 is mounted by slide bolts 90 and 92 and a compression spring 94 which takes up a portion of the front end loading of the grouting machine 20 when in operation with the front caster assembly 58 in raised position. This centrally disposed suspension caster assembly 86 renders the machine easier to pivot for a change of direction during the grouting operation.

The underframe 26 is completed with a front lower transverse frame member 96 which is in the same vertical plane as the side frame members 30 and 32. The upper frame 24 has a similar upper frame member 98 transversely connected there across in the same vertical plane.

Figure 7:
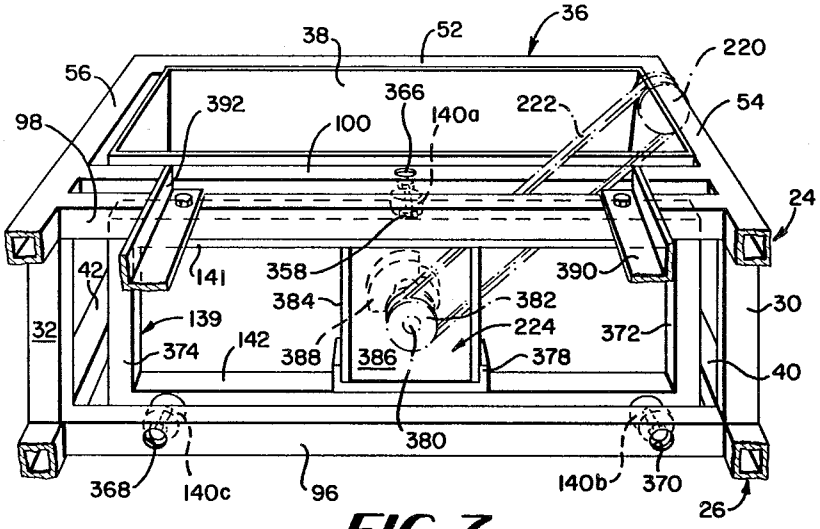
FIG. 7 is a forward cutaway perspective view of the vibrator means mounted on the rear side of the grout hopper.

The front extension frame 36 has a transverse support bar 100 connected between the upper frame members 54 and 56 which is spaced forward from the upper transverse frame member 98 as shown in FIG. 7. This support bar 100 is arranged to provide an upper support for the grout hopper 38 and its associated elements.

The grout hopper 38 is arranged in the front frame extension portion 36 and has a grout dispenser assembly 102 mounted at the lower end thereof by bolts 104. The grout dispenser head or mechanism 106 is provided with runners 108 and 110 mounted on both lateral sides and a front retainer lip 112. A rear wiper 114 is also provided to assure that only a thin film of grout is deposited on the upper surfaces of the positioned tiles along with the dominant filing of the spaces between the tile sides. Angularly arranged grout wiper assemblies 116 and 118 are mounted on underframe 26 via extension member 120 and 122.

The support of the two angular side grout wiper assemblies 116 and 118 by extension members 120 and 122, respectively, is from either side of the rear portion of the grout dispenser mechanism 106. The extension members 120 and 122 are pivotably mounted by connections 124 and 126, respectively and compression springs 128 and 130 whereby they are forced into close contact with the upper surfaces of the tile after the grout has been applied into the spaces between the tiles. The detailed construction of the side-positioned runners 108 and 110 are further detailed in FIGS. 9 and 10 described below. The angular side wipers 116 and 118 have mounting brackets 132 and 134 between which neoprene strips 136 and 138 are positioned for contact with the upper surfaces of the tiles.

The front, side and rear wipers and runners associated with the grout dispenser mechanism 106 together with the angular side wiper assemblies 116 and 118 effectively allow the grout to be dispensed from the grout hopper 38 through the dispenser mechanism 106 and into the side spaces between the positioned floor tiles while leaving only a thin grout film on the upper surfaces of the tiles.

Side flow of the grout out away from the machine is effectively eliminated by the described arrangement. Hence, the grouting machine 20 allows the grout to be laid down in a well defined pathway without side oozing from the dispenser arrangement. The grout hopper is vibrated for the grout depositions step which means that sideways oozing would be a problem for which a solution is required. This grout dispensing mechanism 106 is considered to be an important feature of the present invention in achieving commercially acceptable utilization for grouting machine 20.

The centrally located suspension caster assembly 86 passes over the thin grout film which is thus deposited on the upper tile surface.

A grout hopper suspension frame 139 is positioned immediately to the rear of the hopper 38 and is suspended from the support bar 10 by a single centrally located bolt-mounted grommet **140*a* which spans between the support bar and the top transverse suspension frame member 141. A lower transverse suspension frame member 142 is similarly mounted by bolt-mounted grommets 140*b* and 140*c* to the front side of the lower transverse frame member 96. Other details of the suspension frame 139 are set forth with respect to FIG. 7** below.

The remaining equipment mounted on the machine frame 22 pertains to the grout removal means to which this equipment relates.

Figure 2:
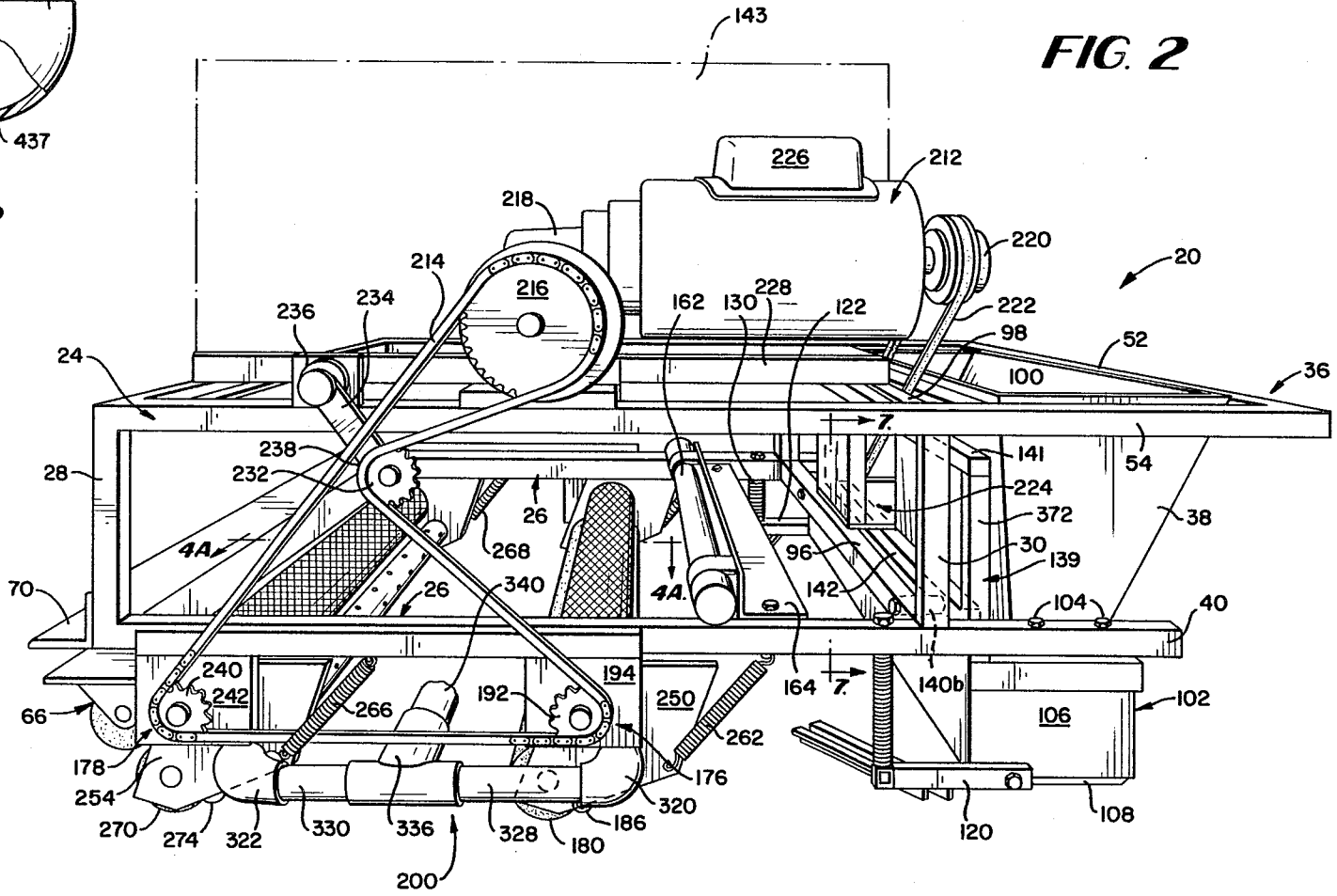
FIG. 2 is a side perspective cut away view of the grouting machine shown in FIG. 1 and illustrates the slurry pick-up assemblies, and the grout assembly means.

Referring now to FIGS. 1 and 2, a slurry storage tank 143 is mounted on the upper rectangular frame 24 and contains therein a watertight compartment 144 which has the foremost plane thereof defined by a watertight baffle 145. Sediment baffles 146 and 148 are also provided with openings 150 provided therethrough at the lower portions to permit fluid flow. A sponge filter 152 is positioned between watertight baffle 145 and sediment baffle 146. A filtered water reservoir 154 is provided at a lower front portion of the sponge filter 152 and the intake line 156 of a water pump 158 is connected to the water reservoir 154. Water pump 158 is connected via an electrical outlet plug 159 to a current source. The output water conduit 160 is connected to a transversely suspended spray tube 162 which is mounted onto the upper surfaces of the lower rectangular frame 26 by a frame angle member 164. A vacuum tight lid 165 is provided for the tank 143.

The spray bar 162 is provided with a series of adjustable spray nozzles 166 which have knurled adjustment knobs 168 positioned thereabout. Water which is filtered from the slurry 170 contained within the slurry storage tank 143 and specifically within the watertight compartment 144 thereof is sprayed onto the thin film of grout 172 in order to create a slurry 174 on the upper surfaces of the tile.

A first and a second slurry pick-up assemblies or means 176 and 178 are mounted onto the lower rectangular frame 26 and are positioned to pickup the grout slurry 174 by a wiping action of the slurry take-up rollers which are in contact with the upper surfaces of the floor tiles. The slurry 174 is first contacted by the front take-up roller 180 of the pickup assembly 176 and lifted about the periphery of the roller into contact with the rotating perforated slurry intake tube 182 which is forced against the peripheral surface of the take up roller 180 by rotating bearing wheels 184 and 185 on the left hand side of assembly 176 and a corresponding set 186 and 187 on the right hand side, both as seen from the direction of the pull handle 46 in FIG. 6. A drive roller 188 is positioned with its peripheral surface 189 in frictional contact with the take-up roller 180 (FIG. 4A) and is in turn connected via an internal core member 190 (FIG. 4A) to a sprocket gear 192 which is mounted in a pickup assembly mounting bracket or plate 194 which is in turn connected to the lower rectangular frame by bolts 196 and 198. The slurry 174 which is picked upon the outer periphery of the take-up roller 180 is thus brought into contact with the rotating perforated intake tube 182 which is in turn connected with a vacuum line conduit system 200 which has the output end 202 extended upwardly within the watertight compartment 144 of the slurry storage tank 143. The grout slurry 174 thus passes into the slurry intake tube 182 and is then transported via the moving air stream within the vacuum connector assembly into the watertight compartment 144 and is deposited into the slurry mass 170. The vacuum is drawn through air intake 204 of a vacuum pump 206 which is mounted on the lower side of the upper rectangular frame member 24 and which has a vacuum pump motor 208 mounted therebelow.

The airflow through the vacuum conduit assembly 200 thus passes along the top of the sentiment baffles and the watertight sentiment baffles 146 and 148 and the watertight baffle 145 and enter the air intake tube 204. The air flow passing out of the vacuum pump impeller 210 can usefully be employed to cool the main drive motor 212 shown in FIG. 2 as described below with respect to FIG. 11.

Both the front slurry pickup assembly 176 and the rear pickup assembly 178 have identical construction which will be further described below. The sprocket gears of these two assemblies illustrated by sprocket gear 192 of the front pickup assembly 176 are connected via a sprocket chain 214 to a drive gear 216 which is powered by the drive motor 212 through a gear reduction box 218 attached to the rear end thereof. The front drive pulley 220 has a v-belt 222 which drives a vibrator mechanism 224 which is attached to the rear portion of the grout hopper 38 and functions to mechanically vibrate the hopper within the frame construction in order to provide more efficient dispensing action for the grout which has a high density paste consistency.

It is desirable to begin the operation of the grouting machine 20 with an initial charge of water in the watertight compartment 144 so that the grout slurry 174 will not clog the sponge filter 152. Also, the initial charge of water is required for the operation of the spray bar 162.

Figure 3:
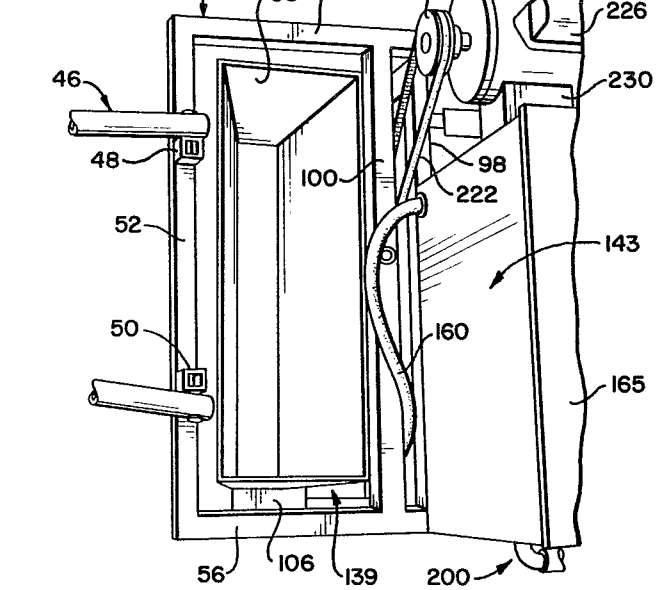
FIG. 3 is a top view of the slurry storage hopper and shows the drive motor and slurry storage tank mounted on the top side of the machine frame.

The drive motor 212 has a solenoid switch assembly 226 mounted at the top thereof and the entire drive motor is mounted on a base 228. A side support bracket 230 is provided between the side of the drive motor and the slurry storage tank 143 (FIG. 3).

The sprocket chain 214 shown in FIG. 2 is driven by the drive gear 216 and is passed around an idler gear 232 which is suspended on an arm 234 which is mounted in a coil spring biased pivot fitting 236 in order to exert a downward force at the elbow turn 238 for maintaining tension on the sprocket chain 214. The sprocket chain 214 is then utilized to drive the pick-up assemblies 176 and 178 via the sprocket gears 192 and 240, respectively.

DETAILED OPERATION OF SLURRY PICK-UP ASSEMBLIES

Each of the two slurry pickup assemblies 176 and 178 are suspended from the underside of the lower rectangular frame 26 by depending mounting brackets or plates 194 for assembly 176 and 242 in the case of assembly 178 on the left hand side as seen from the bifurcated handle 46 in FIG. 1. Corresponding mounting brackets to plates 244 and 246 are mounted on the right hand side of the lower frame 26 as seen in FIG. 5. The drive rollers 188 of assembly 176 and 248 in the case of assembly 178 are rotatably journaled between the two sets of depending mounting plates and extend between the mounting plates for the full working widths of the slurry pick-up assemblies 176 and 178. The slurry take-up rolls and the associated perforated slurry intake tubes are; however, rotatably mounted in adjustable pivot plates 250 and 252 in the case of assembly 176 and in plates 254 and 256 in the case of the rear assembly 178. These two pairs of adjustable mounting plates are attached for pivotal motion about the axes of the drive rollers 258 and 260 for each of the two drive rollers 188 and 248, respectively. The two pairs of adjustable mounting plates are urged in a forward pivoting motion by the side mounted tension springs 262 and 264 in the case of the front assembly 176 and springs 266 and 268 in the case of the rear assembly 178. The rear slurry pick-up assembly 178 is also fitted with a slurry take-up roller 270 which is rotatably journaled between the pivotably adjustable mounting plates 254 and 256 and with a slurry intake tube 272 which is rotatably mounted between these same two adjustable mounting plates 254 and 256. Slurry intake tube 272 is urged into frictional contact with the take up roller 270 by rotatably mounted wheel bearings 274 and 276.

The two pairs of tension springs which urge the pairs of pivotably adjustable mounting plates in a forward arcuate direction are springs 262 and 264 in the case of the front pick-up assembly 176 (FIG. 6) and springs 266 and 268 for the rear pickup assembly 178. These two pairs of tension springs are secured to the axles of the lowermost bearing wheels for the slurry intake tubes (although a separate mounting post could equally well be utilized as shown in the FIG. 2 embodiment). The other ends of these tension springs are fixed to pins in the underside of the rectangular frame 26 as shown in FIGS. 1 and 2.

The tension in the pairs of springs affixed to the lower frame 26 urge the slurry take up rollers 180 and 270 to move in an arcuste path about the periphery of the drive rollers 188 and 248 and thus pivot the adjustable mounting plates 250, 252 in the case of the front assembly 176 and 254 and 256 in the case of the rear assembly 178 to rotate in the forward direction of the drive rollers. The effect of this movement is to cause the slurry take-up rollers 180 and 270 to move more directly under the drive rollers and to thus provide a more thorough and forceful wiping action across the upper surfaces of the tile pattern which is being grouted. At the same time, because of the rotatable journaling of the slurry intake tubes 182 and 272 in the same adjustable mounting plates the relationship of these slurry intake tubes with respect to the take up rollers 180 and 270 and to the respective drive rollers 188 and 248 is not changed whereby the frictional contacting of these rollers with respect to one another is maintained. The drive rollers 188 and 248 are in intimate frictional contact with the respective slurry take up rollers 180 and 270, respectively. These two take up rollers are in turn in frictional drive contact with the respective slurry intake tubes 182 and 272 whereby the same are rotated by the slurry take-up rollers. The wheel bearings 184, 185 in the case of intake tube 182 and 274 and 276 in the case of intake tube 272 and the corresponding wheel bearings on the other side of the machine 20 are also journaled in the pivotably adjustable mounting plates whereby the same frictional contact force is maintained to ensure rotation of the intake tubes.

Figures 4A, 13:
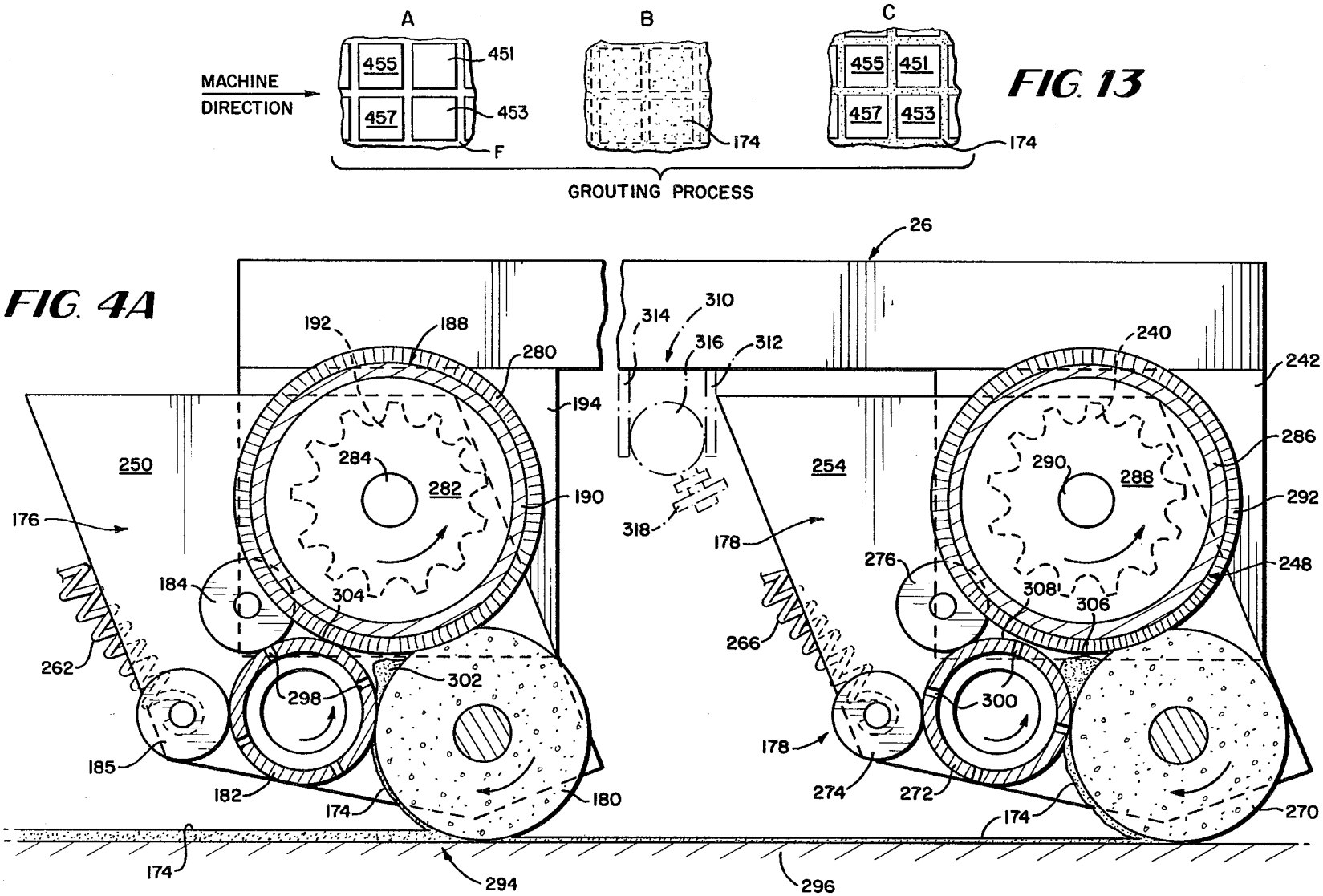
FIG. 4A is a detailed side view of the two slurry pick-up assemblies taken on line 4A—4A of FIG. 2.
FIG. 13 is a schematic diagram of the grout depositing and pick-up steps carried out by the grouting machine.

The construction of the drive rollers 188 and 240 is seen is FIG. 4A wherein an inner core tube or member 190 provides the support for an outer embossed or configured neoprene layer 280. The core tube 190 is a polyvinylchloride extruded tube. The outer neoprene sleeve 280 is configured with a ribbed pattern to provide drive contact with the associated slurry take up roller 180. The two ends of the PVC tube 190 are plugged with spanners as shown by member 282 for the forward assembly 176. The spanners are in turn affixed to axle pins illustrated as pin 284 which is in turn intimately affixed to the outer drive gear 192 (shown in phantom line). A similar construction is employed for the drive roller tube 248 of the rear assembly 178 wherein an inner core or PVC tube 286 is connected to an internal spanner 288 which is in turn connected to the axle pin 290 for contact with the outer sprocket gear 240 (in phantom line). The outer configured neoprene sleeve 292 is fixed to the inner PVC tube 286 and is in intimate drive contact with the associated slurry take up roller 270.

Also seen in FIG. 4A with respect to the forward pick-up assembly 176 is the wiping action which occurs at the nib area 294 of the slurry take up roller 180. The slurry is wiped away from the upper surfaces of the tiles, illustrated as surface 296 and is lifted into contact with the slurry intake tube 182. The perforations 298 shown in FIG. 4A are arranged on axial quadrants along the length of the slurry intake tubes 182 and 272 (the perforations in the latter being designated by numeral 300). The flow of air is pulled through these perforations by the vacuum pump 206.

As the slurry 174 is wiped from the upper tile surface 296, it tends to move between the take up roller 180 and the slurry intake tube 182 as seen in the forward assembly 176 and to then be squeezed forward into the nib space 302 between the drive roller 188 and the take up roller 180. The clearance between the drive roller 188 and the slurry intake tube 182 illustrated by numerals 304 then causes air to be sucked through this narrow transverse opening and for the slurry accumulated in the nib space 302 to be drawn into the rows of perforations as these rotate past the nib space 302. The slurry 174 is thus drawn into the slurry intake tube 182 and then into the slurry conduit system 200 (FIG. 1). The slurry is drawn toward both the right hand and the left hand directions since the slurry conduit system 200 is connected to both ends of the slurry intake tubes 182 and 272. A similar action occurs in the rear slurry pickup assembly 178 where the remaining slurry 174 is accumulated in the nib space 306 an a narrow air clearance 308 provides for the in-rush of air through the perforations illustrated by numeral 300.

If desired, a second diluent spray tube system 310 as illustrated by phantom lines in FIG. 4A can be affixed by members 312 and 314 to the underside of the frame 26 and can have a spray tube 316 with sprayheads illustrated as head 318 for spraying diluent on the upper surface of the tile layer 296 which is presented by the forward movement of the grouting machine 20 between the two sets of slurry pick-up assemblies. In this manner, any minor amounts of grout or grout slurry which remain on the upper surfaces of the tile can be loosened up by additional diluent or water addition in order to form a lower density slurry for pick-up by the rear slurry take up roller 270.

SLURRY CONDUIT SYSTEM

The slurry conduit system 200 is connected to both ends of the two slurry intake tubes 182 and 272 by rigid plastic elbows 320 and 322 as illustrated in FIG. 2 for the lefthand side of the grouting machine 20 when seen from the pull handle 46 and by elbows 324 and 326 attached to the right hand side of the two slurry intake tubes. Rotatable slurry-tight collars of conventional construction are employed for the connection between these two elements. These four rigid plastic elbows are, in turn, connected to short lengths of flexible neoprene tubing illustrated as 328 and 330 in FIGS. 2 and 5 on the left hand side and 332 and 334 on the right hand side. These flexible lengths of tubing provide for movement of the pivotally adjustable mounting plates 250, 252 and 254 and 256, respectively for the two pick-up assemblies. These four lengths of flexible tubing are connected to a centrally located rigid T connector 336 on the left hand side and 338 on the right hand side of the grouting machine 20. The T connectors are, in turn, connected to additional lengths of flexible tubing 340 and 342 which are connected to a centrally located T fitting 344 which is connected to the slurry input tube 202 illustrated in FIG. 1. The slurry is moved upwardly through the slurry conduit ystem 200 as thus described by the flow of air through the perforations in the slurry intake tubes 182 and 272. The slurry is then deposited in the slurry reservoir 170 within the slurry storage tank 143 as described above.

It will be seen from a comparison of the slurry conduit system 200 as seen in FIGS. 1 and 2 that the exact form of the connection between the slurry input tube 202 and the slurry intake tubes 182 and 272 can vary. For example, FIGS. 2 and 5 as described above have T connectors 336 and 338 at either of the left hand and right hand sides, respectively. These can be replaced by "Y" form connectors such as illustrated by numeral 348 in FIG. 1 which are then positioned at a slightly higher elevation and which provide somewhat better flexibility in the connecting flexible tube lengths 328 and 330 as seen in FIG. 1. Other obvious connection arrangements can also be employed for this slurry conduit system 200.

UTILITY DETAILS

As seen in FIG. 1 electrical control lines 350 and 352 can be provided for controlling the vacuum pump 206 and the water pump 158, respectively, from a position on the pull handle 46. A similar control line can be utilized on the pull handle for controlling the drive motor 212.

As seen in FIG. 1 a rubber apron 354 is affixed to the lower front sidewall of the slurry storage tank 140 by a series of fasteners illustrated by fastener 356. Similar fasteners 358 are provided at the back lip of the grout hopper 38. The purpose of the apron is to prevent grout from falling in the space between the rear of the grout hopper 38 and the vertical frame members 30 and 32 which could have the effect of clogging the vibrator mechanism 224 which is brief described with respect to FIG. 2 above and which is described in greater detail with respect to FIGS. 7–9 below. Front and side aprons are also provided for connecting the upper edges of the hopper 38 to the surrounding front extension frame 36 for the same reason. These aprons have been removed from the drawings for clarity.

The rear wiper 114 briefly identified in the above description for FIG. 1 is adapted for being fed against the upper tile surfaces as it is worn away by abrasion. Referring now to FIG. 1, the neoprene wiper 114 is fed between two rotatable spiked rollers 360 and 362 which are fitted with outside adjustment knobs (not shown) for manual adjustment. As the neoprene wiper 114 is worn off by abrasion, the two spiked rollers 360 and 362 are rotated toward one another in a direction of the arrows as shown to feed the wiper sheeting down against the upper tile surfaces. This has proven to be an effective means of dealing with the high abrasion grout material which is utilized by the grouting machine 20.

The spiked rollers 360 and 362 extend through the width of the grout dispensing head 106. The grout within the grout hopper 38 is thus in intimate contact with the upper surface of the tile during the grouting operation, and is being shaken downwardly by reason of the vibrator mechanism 224 which is operated by the front drive belt 222 from the front pulley 220 of drive motor 212 as further described below. The vibratory action of the open-bottomed dispenser head 106 thus shakes the grout paste into the spaces between the prepositioned tile pattern, and the side runners 108 and 110 prevent the lateral oozing of the grout beyond the predetermined path width of the dispensing head 106. Next, the rear wiper 114 wipes away all but a thin film of grout on the upper tile surfaces. The diluent spray tube 162 then adds diluent to the grout film in order to form a slurry which is then picked up by the two sequentially contacting slurry pickup assemblies 176 and 178 for which the slurry pick-up action is described above.

VIBRATOR MECHANISM

FIG. 7 shows a front perspective view taken from just behind the grout hopper 38 in FIG. 2 and shows the upper and lower rectangular frames 24 and 26 broken away. In this view the attachment of the rubber vibrator grommets to the hopper suspension frame 139 can be seen. The upper centrally located rubber grommet **140*a* is connected in a vertical plane between the support bar 100 and the upper suspension frame member 141. The grommets used are of the form of a rubber sleeve which is held in place between the two frame members by a connecting bolt and washer. A connection opening 366 is provided through a portion of the support bar 100 for this purpose. The frame members employed in the grouting machine 20 are preferably in the form of hollow square or rectangular cross section extruded tubing which permits access openings such as 366** to be drilled out from one side of the frame member to provide for easy connection and assembly of such mounting grommets.

Figure 8:
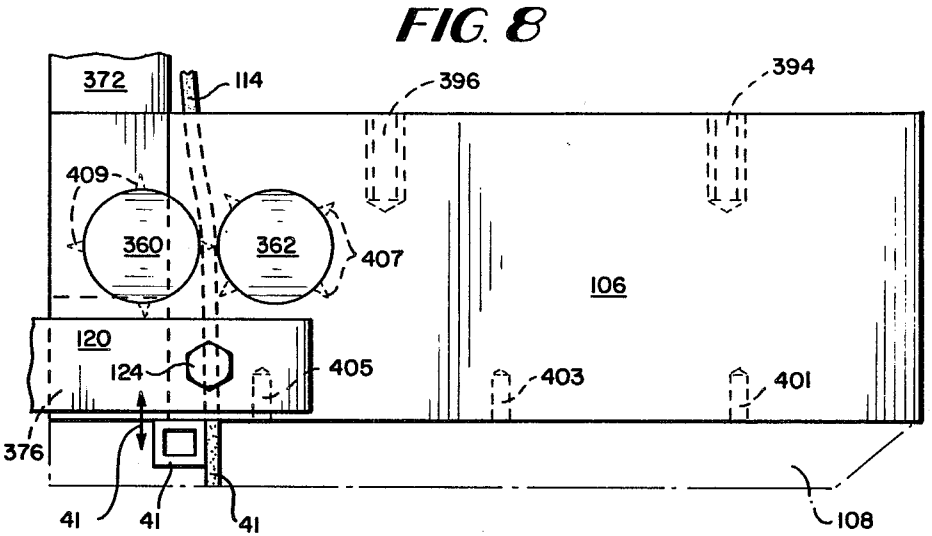
FIG. 8 is a detailed side view of the grout dispenser means.
Figure 9:
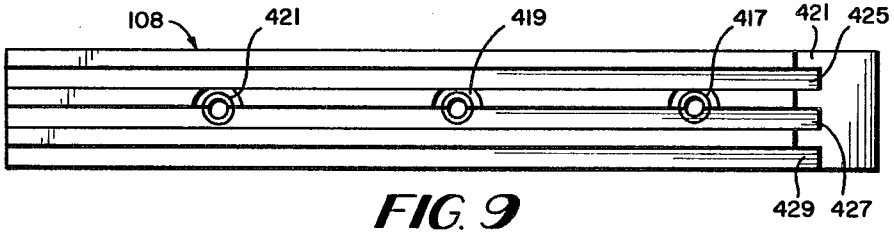
FIG. 9 is a detailed bottom plane view of one of the grout wiper means.
Figure 10:
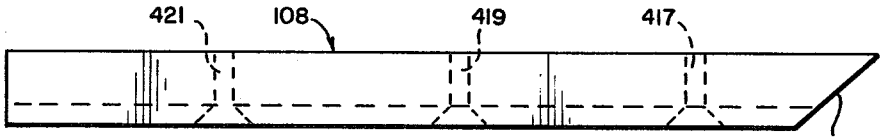
FIG. 10 is a side elevation view of the wiper means shown in FIG. 9.

The lower transverse suspension frame member 142 is similarly suspended from rubber grommets **140*b* and 140*c* from the transverse frame member 96 and openings 368 and 370 are formed in the rear of frame member 96 for ease of connection. The suspension frame 139 has side frame members 372 and 374 which extend downwardly below the lower rectangular frame 26 to provide support for the grout distribution head 106 as shown in FIG. 8. A lower transverse suspension frame member 376 connects the lower ends of the two side frame members 372 and 374**.

The vibrator mechanism 224 is then connected by a bracket connection 378 as shown in FIG. 7 between the transverse suspension frame members 141 and 142. The vibration mechanism 224 is formed with an axle 380 which has a sheave mounted between a front wall 384 and a rear wall 386. An eccentric weight 388 is attached to a sleeve (not shown) mounted on the axle 380. A common cable clamp can be employed as the eccentric weight 388.

The "V" belt 222 which is driven by the driven motor pulley 220 then rotates the sheave 382 which then rotates the eccentric weight 388 and provides vibratory motion for the suspension frame 139 and the connected grout hopper 38. The connections between the grout hopper 38 and the suspension frame 139 and the grout suspension head are by means of connection bolts.

It has been found expedient to utilize plexiglas construction for the vibrator mechanism housing walls 384 and 386.

In FIG. 7 the internally spaced "L" frame members 390 and 392 which provide support for the storage tank 143 are also shown with the same fragmentation as for the upper rectangular frame 24 and the lower frame 26.

Referring now to FIG. 8, the grout dispenser head 106 is shown with upper threaded bolts holes 394 and 396 into which the connection bolts 104 extend to connect the grout hopper 38 to the dispenser head 106. The form of the dispenser head is a rectangular box which forms an extension of the hopper 38 and has a bottom opening 398 (FIG. 5) through which the grout is dispensed. The side runner 108 is shown in phantom lines connected to the bottom of the grout dispenser head 106 for which bolt holds 401 to 403 and 405 are provided.

The rearmost grout wiper 114 is seen positioned between the two spiked rollers 360 and 362 which have spike sets 407 and 409 positioned on the surfaces thereof to provide for engaging the wiper 114 which is preferably a neoprene sheet. The wiper 114 is preferably backed up near its lower most extremity by a square cross section back-up bar 411 which can be preferably mounted for a slight vertical adjustment as shown by the doubleheaded arrow 413. A conventional adjustment means consisting of two adjustment screws can be employed for this purpose. The reason for the adjustable feature for the backup bar 411 is that various grout material have varying densities which means that the force necessary to prevent the grout from slipping under the lower lip 415 of the wiper 114 varies.

In FIG. 8 the detailed construction of the side suspension frame member 372 and its lower transverse suspension frame connection member 376 can also be seen.

FIGS.. 9 and 10 show details of the side runner 108 which has a series of three countersunk bolt holes 417, 419, and 421 through which screws or bolts are extended into the bolt openings 401, 403, and 405 on the bottom of the grout dispensed head 106. The runner has a beveled leading edge 423 which is seen in the bottom view 9 and the side view 10. A series of three neoprene strips 425, 427, and 429 are embedded into the under surface of the metal runner 108 to assure intimate contact with the tile upper surfaces.

DRIVE MOTOR COOLING SYSTEM

Figure 11:
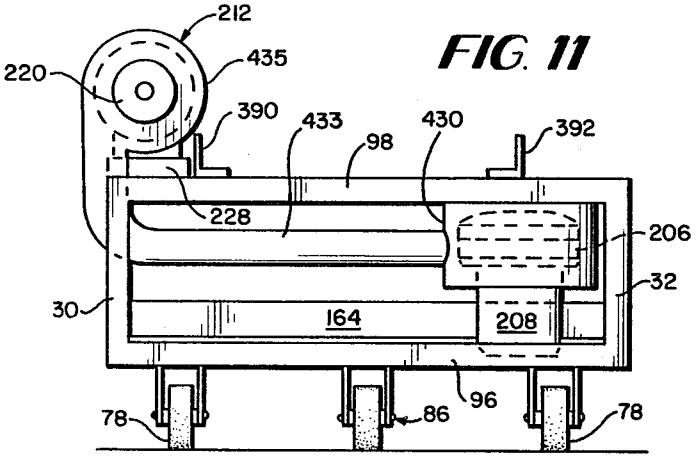
FIG. 11 is a schematic view of the ducy arrangement used for supplying air from the vacuum pump to the drive motor for cooling purposes.

A shown in FIG. 11 a cowl 430 can be placed around the vacuum motor 206 so that the air which is drawn through the slurry intake tubes 182 and 272 and is passed through the storage tank 143 can be conducted by a conduit 433 into a shroud 435 which is positioned about the drive motor 413 in order provide cooling for the same. The shroud 435 provides for the front pulley 220 extending therethrough. This provides an efficient, low cost drive motor cooling means.

Figure 12:
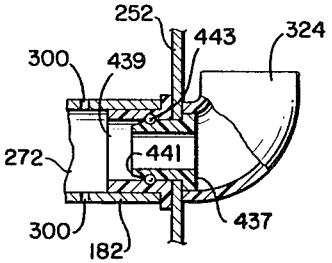
FIG. 12 is a detailed view of a preferred embodiment of the bearing means for mounting the perforated slurry intake tube of the slurry pick-up assembly.
Figure 4:
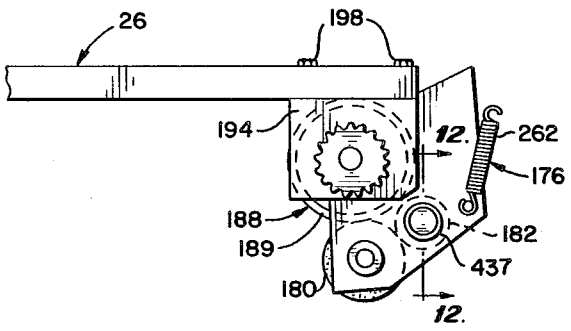
FIG. 4 shows a detailed side view of an embodiment of the slurry pick-up assemblies.

As shown in FIGS. 4 and 12 an internal bearing sleeve arrangement can be used to provide the rotational support means for the slurry intake tubes 182 and 272 and as such provide a somewhat lower cost replacement for the bearing wheels, 184, 186, 274 and 276 as shown in FIG. 4A. To provide for this internal bearing support an inner thimble 437 is extended through an opening in the pickup assembly bracket 252. A connector fitting 439 is then employed in the end of the slurry intake tube 182 which fitting has an inner diameter which fits over the slightly tapered innermost end 441 of the thimble 437. Annular grooves are formed in both the connector member 439 and the thimble 437 in order to provide a mounting for an O-ring 443 which is deformed slightly by the grooves in order to maintain an airtight seal. The materials of construction for the thimble 437 and the O-ring 443 are preferably nylon. The slurry conduit elbow 324 is then connected about the outer shoulder of the thimble 437 as shown in FIG. 12.

OPERATING SEQUENCE

FIG. 13 shows the several steps which are effected by the grouting machine 20. As the machine proceeds in the direction shown, it first encounters the prepositioned tile pattern A shown as 451, 453, 455, and 457. These tiles are secured to the floor F by suitable glue. When the grout dispensing head 106 of machine 20 passes over the prepositioned tile, grout 174 is deposited in the space between the sides of the tiles as well as on the upper surfaces of the tiles. The rear wiper 114 serves to reduce the thickness of the grout deposited on the upper tile surfaces 296 to only a thin film.

As the machine is pulled across the tile area shown as B the diluent or water from the spray tube 162 (and tube 316 when employed) forms a slurry of the grout and the pick-up assemblies 176 and 178 then take-up the slurry via the take-up rollers 180 and 270 in order to remove the slurry 174 from the upper surfaces of tiles 451-457 (odd numbered) while leaving the grout 174 in the spaces between the side of the tiles as shown in area C which represent the final grouted floor produced by the grouting machine 20. The sequence of steps illustrated by the tile areas A, B, C in FIG. 13 illustrate the grouting process performed by machine 20.

DESCRIPTION OF THE PREFERRED EMBODIMENT

The preferred embodiment of the grout removal machine of the present invention is shown in FIGS. 14–30 and is equipped with a grout pick-up assembly which accommodates a power driven grout removal belt rather than the grout take-up rollers 180 and 270 described with respect to the embodiment of FIGS. 1–12 above. The parts of the grout removal machine shown in FIGS. 14–30 will be briefly described with reference to the machine illustrated in FIGS. 1–12 and the subsequent description will not repeat in detail those elements which have already been fully described with respect to FIGS. 1–12.

Figure 14:
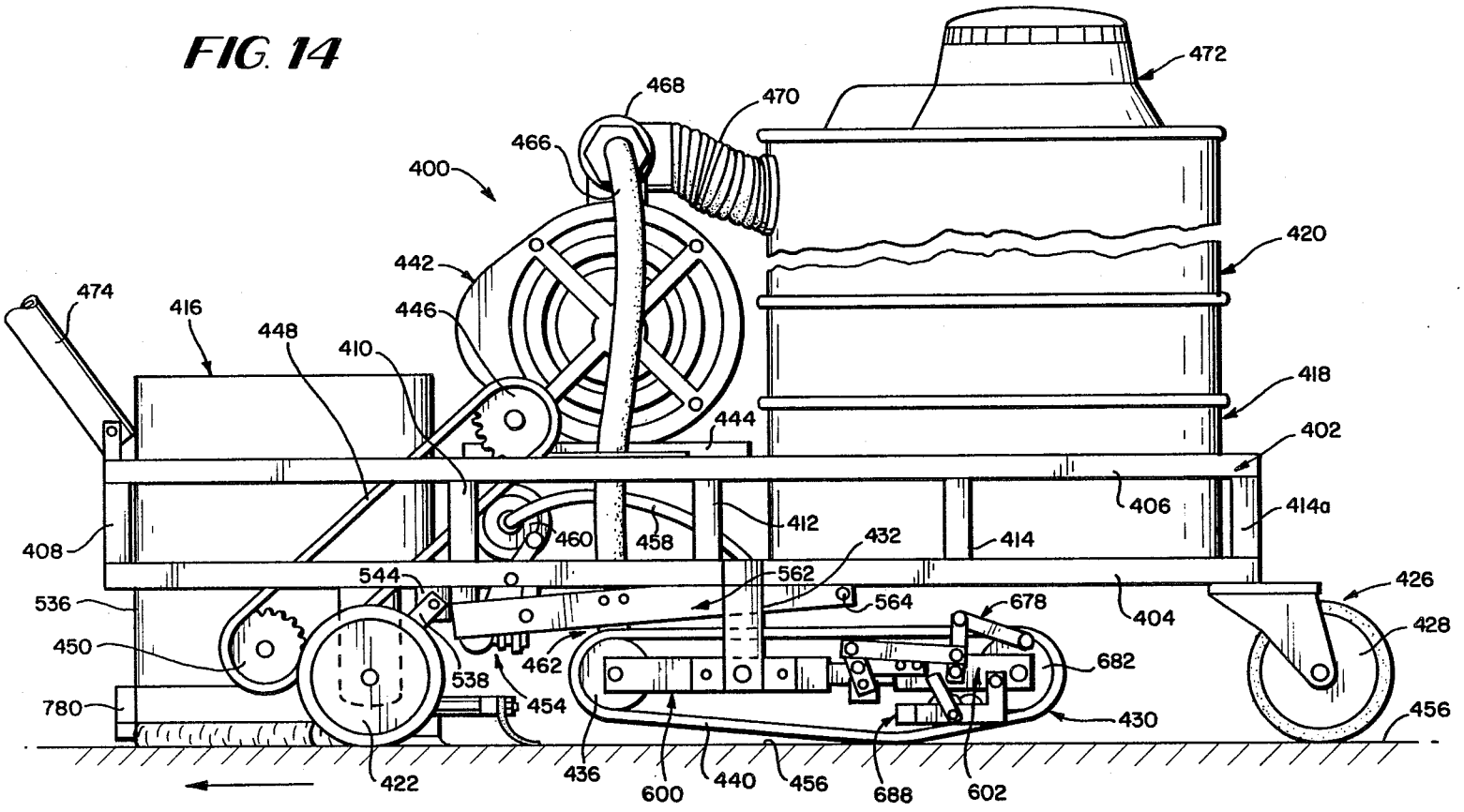
FIG. 14 is a side elevation view of a preferred embodiment of the grouting machine of the present invention.

The preferred embodiment grouting machine 400 has a main frame 402 comprised of a lower rectangular frame 404 and an upper rectangular frame 406 constructed of angle iron or other suitable elements which are separated by a series of vertical support members illustrated by left side even numbered members 408-414 and **414*a* shown in FIG. 14. The machine 400 also has a front mounted grout hopper 416 and a rear mounted diluent tank 418 which is secured within main frame 402 and a removable slurry tank 420 which is designed to set removably on top of water tank 418**.

The grout hopper 416 is secured within the main frame 402. The main frame 402 is supported by a left front caster wheel 422 and a right front caster wheel 424 (FIG. 16) as well as a single rear swivel mounted caster wheel assembly 426. Rear caster wheel assembly 426 is provided with a caster wheel 428 which is similar to the front caster wheels 422 and 424. Vertical supports corresponding to supports 408-414 and **414*a* are also provided for the right side of the main frame 402 but are not shown in FIGS. 14–30**.

Figure 16:
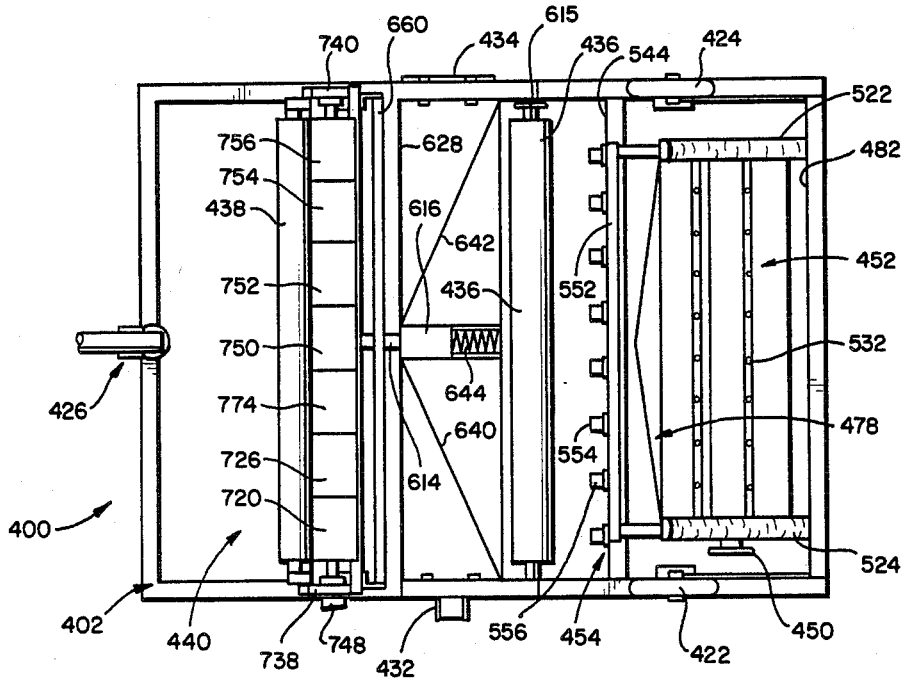
FIG. 16 is a bottom plan view of the grouting machine illustrated in FIG. 14.

An underslung grout pick-up assembly 430 is positioned below the main frame 402 by a latch bracket 432 on the left hand side as shown in FIGS. 14 and 16 and a mounting plate 434 on the right hand side positioned laterally across the main frame 402 (FIG. 16). The grout pick-up assembly 430 is provided with a front driven roller drum 436 and a rear idler roller drum 438. A grout removal belt 440 is positioned about the front and rear roller drums and extends on the top and bottom sides of the grout pick-up assembly 430.

A drive gear motor 442 is provided and is mounted on a cross mounting plate 444 which extends between the left and right sides of the top rectangular frame 406. The drive gear motor 442 operates the front driven roller drum 436 and a left side sprocket drive gear 446 which in turn supplies power for sprocket chain 448 and operates grout dispenser sprocket wheel 450. The grout sprocket wheel 450 in turn operates a paddle wheel 452 shown in FIGS. 15 and 16 in top and bottom views, respectively.

A diluent addition means 454 is positioned immediately in front of the belt 440 for supplying water or other diluent onto the belt and/or the upper tile surface 456. The diluent is supplied through water pipe 458 and the water pump 460. The diluent pipe 458 is in turn connected to the diluent or water tank 418.

Figure 15:
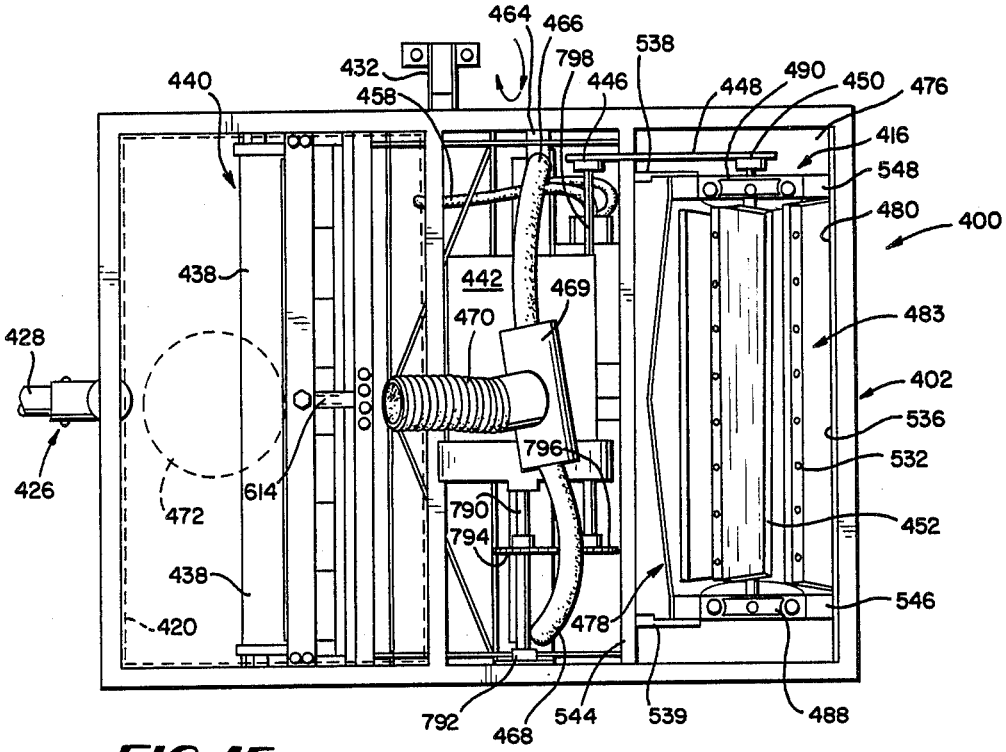
FIG. 15 is a top plan view of the machine illustrated in FIG. 14.

A grout removal means 462 is positioned immediately on top of the front portion of the belt 440 near the position of the front roller drum 436. The grout removal means includes a grout intake manifold best shown in FIGS. 20, 21, and 21A. The grout intake manifold or means 464 is, in turn, connected to a left and right hand side pair of grout conduit risers 466 and 468 (FIG. 15). These two conduit risers are, in turn, connected to a grout conduit junction 469 which is, in turn, connected through a grout conduit 470 into the removable slurry tank 420.

A vacuum source motor 472 is provided in the top of the slurry tank 420 in order to provide a low pressure within the tank to assist in drawing air and the grout slurry upwardly through the grout conduit risers 466 and 468.

A front mounted pull handle 474 is connected to the front of the mainframe 402 and serves the same function as handle 46 of FIG. 1. Having thus described the principle features of the preferred embodiment machine 400 the details operations of the various components will now be described.

GROUT HOPPER

The grout hopper 416 is connected within the front portion of the main frame 402 and is spaced from the left a d right hand sides as shown in FIGS. 15 and 16. The left mounting space 476 provides for the mounting of the grout dispenser sprocket wheel 450. The shape of the grout hopper 416 is a rectangular box open at the top and bottom with the exception that the rear wall 478 is V-shaped with the V in the center of the grout machine 400 as shown in FIGS. 15 and 16. Grout is loaded into the top opening 480 and is then dispensed out of the bottom opening 482 (FIG. 16). The trowel or paddle wheel 452 is rotated by sprocket wheel 450 which is in turn driven by the gear motor 442 through the drive gear 446 and sprocket chain 448. The combination of the grout hopper 416 and the trowel or paddle wheel 452 provide a grout dispensing means 483.

Figure 17:
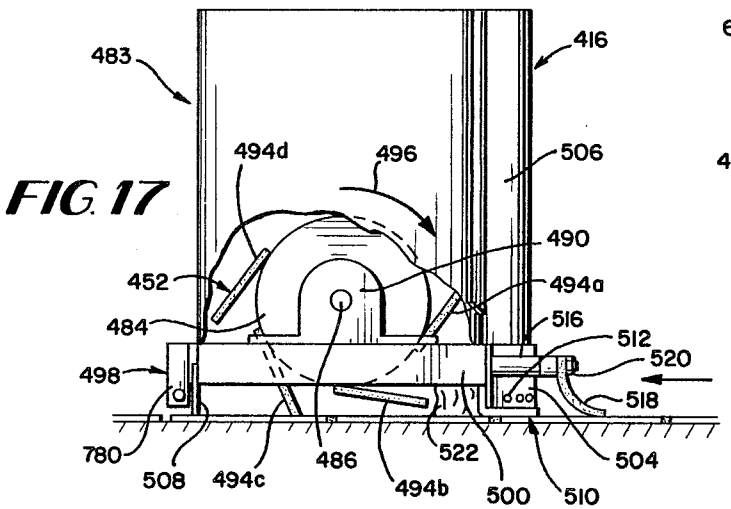

The paddle wheel 452 is formed by a drum 484 (FIG. 17) which is supported by a paddle wheel axle 486. The right and left hand ends of the axle 486 are journaled in right and left hand pillow blocks 488 and 490, respectively as best shown in FIGS. 15 and 17. The trowel or paddle wheel 452 has a series of trowel blades 494*a*, 494*b*, 494*c* and 494*d* as shown in FIG. 17. The angle of the trowel blade to the circumference of the drum 484 has been found to be optimum for pushing the grout from the grout hopper 416 into the grooves between the laid tiles as shown in FIG. 13. The paddle wheel is rotated in the direction of arrow 496 by the operation of the sprocket chain 448 and the sprocket gear 450 of FIG. 14. The grout is pushed and wiped into the spaces between the laid tile pieces and is also wiped away from the tile upper surfaces by the action provided by the grout dispensing means 483.

Other details of the grout dispensing means 482 are the bottom support bracket assembly 498 which consists of right and left hand side hopper bottom braces shown by the left hand brace member 500 and a front connecting brace 502 (FIG. 23). The rear hopper bottom brace 504 is also constructed in a V-shape to conform to the shape of the rear wall 506 of the grout hopper.

A front floor gasket 508 is provided immediately behind the front brace member 502 for containing the grout against forward oozing under the front bottom lip of the grout hopper 416 (FIG. 17). Also a main squeegee or rear floor gasket 510 is provided in the same V-shape as the rear brace 504 and is connected thereto by a series of connecting brads illustrated by brad 512. The shape of the main squeegee 510 is that of a flat vertical positioned bar. 514. Also connected to the bottom brace 498 is a rear spacer 516 which has connected thereto a joint smoothing blade 518. A smoothing blade retainer 520 is provided for a removable connecting element in order to change the smoothing blade 518 when it becomes worn. The rearward curving shape of the blade 518 is important in order to sweep down into the wet grout joint between the positioned tiles and push the wet grout top surface toward the back of the space between each of the positioned tiles since the effect of the main squeegee 510 will have been to push the grout toward the front of each of the joints. The lateral shape of the smoothing blade 518 can be straight across under the grouting machine 400 or can be angled to be parallel to the main squeegee 510 so that it has a V-shape conforming to the rear wall of the grout hopper 416.

The grout hopper 416 is also provided with side positioned floor gaskets or runners 522 and 524 as shown in FIG. 23. The front bracket member 502 is shown along with the rear positioned main squeegee 510 which is secured to the rear brace 504 (shown in dashed lines. The connecting brads illustrated by brad 512 are shown in a line connecting the main squeegee 510 to the rear brace 504. A similar series of connecting brads 526 are provided for connecting the front brace 502 to the bottom of the grout hopper front wall 528. The V-shape of the grout hopper rear wall 530 can be seen in FIG. 23.

Connecting brads or screws illustrated by brad 532 are also used to connect the trowel blades 494*a–d* to the drum 484 as shown in FIGS. 15 and 16. Also shown in FIG. 23 is the main squeegee retainer strip 534 which is also connected by the brads or screws illustrated by brad 512. The side floor gaskets 522 and 524 can preferably be constructed of surgical tubing which has the property of high abrasion resistance.

The front grout hopper bottom brace 502 is in turn connected to a vertical support hanger 536 which is connected to the main frame 402 as shown in FIG. 14. This hanger positions the lower front lip of the grout hopper 416 and assures that the front floor gasket 508 will remain in contact with the tile upper surfaces. Also, a left rear grout hopper brace 538 and a corresponding right rear hopper brace 539 are provided also as shown in FIG. 14 for securing the rear portion of the hopper bottom brace 498. The front hanger member 536 extends across the internal width of the main frame 402 and is connected to the outer portions of the front lower bracket member 502 at connection points 540 and 542 as shown in FIG. 23.

The left and right rear hopper braces 538 and 539 are connected to the main frame 402 by mounting bar 544 which extends laterally across the width of the grouting machine 400 as shown in FIG. 15. the pillow blocks 488 and 490 for journaling the grout paddle wheel 452 axle 486 are positioned on internally arranged brace members 546 and 548 on the right and left hand sides of the interior of the grout hopper 416, respectively.

DILUENT ADDITION MEANS

The diluent addition means 454 is shown in greater detail in FIGS. 16, 20, 21, and 21A.

A diluent manifold 552 is provided for extending across the machine 400 and extending across the width of the grout hopper 416 as shown in FIG. 16. A plurality of spray nozzles illustrated by nozzles 554 and 556 are shown equally spaced across the width of manifold 552. Eight (8) spray nozzle heads are provided although the number can be varied. The diluent pipe 458 is connected to the left end of the diluent manifold 552 via a fitting 558. Each of the spray nozzle heads illustrated by heads 554 and 556 are provided with hex nut adjustments illustrated by hex nut 560 in FIG. 21.

The diluent manifold 552 is mounted on the front end of an intake manifold support bracket 562 which is pivoted about the underside of the main frame 402 at pivot connector 564 as shown in FIG. 14. The intake manifold support bracket 562 is formed with a left side bracket member 564 and a right side bracket member 565 both of which provide for the connection with the left and the right hand end of the diluent manifold 552 as partially shown in the fragmentary view of FIG. 21A. The front portion of the intake manifold support bracket 562 provides for a coil spring seat member 566 on the left and right hand side as shown for the left hand bracket member 564 in FIG. 21A. A coil spring 568 is shown positioned on the ring retainer member. Coil spring 568 is one of a pair of springs which extends from the spring seat up to a cross bar 570 which extends between the left and right hand side of the lower rectangular frame 404. Movement of the intake manifold support bracket upwardly compresses the spring set illustrated by spring 568 as shown in FIG. 21. The spring 568 is shown in the extended position in FIG. 20. Movement between the extended position shown in FIG. 20 and the compressed position shown in FIG. 21 is accomplished by a forward toggle linkage lever 572. The purpose of movement of the intake manifold support arm upwardly is to take the intake manifold 464 out of contact with the grout take-up belt 440 and operation of the toggle link 572 will be further explained below in reference to the grout take up assembly.

GROUT PICK-UP ASSEMBLY

Figure 18:
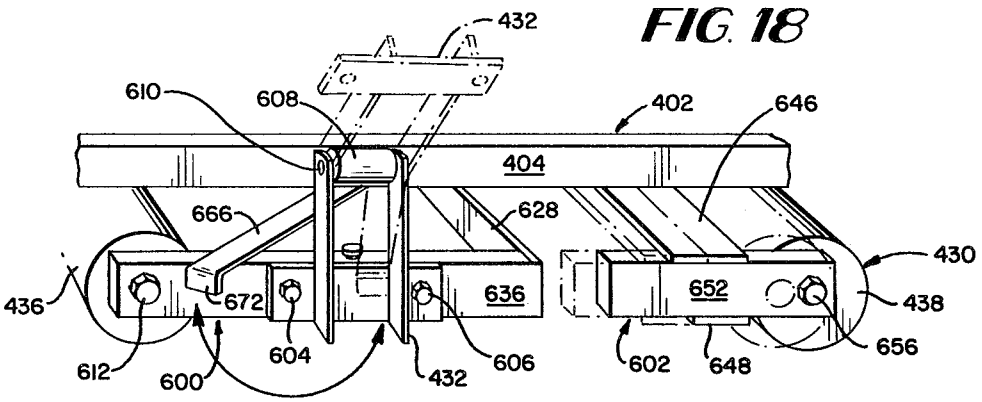
FIG. 18 is a partial side view of the grout pick-up assembly shown without the grout pick-up removal belt.

The grout pick-up assembly 430 has been briefly described above and will now be described in detail with specific respect to FIGS. 14, 16, 18, 19, 20, 21, 21A, 22, and 25–30. The grout pick-up assembly is a major feature of the grouting machine 400 as shown in FIGS. 14, 16, 18, and 19. The grout pick-up assembly 430 has a front frame 600 and a rear frame 602. The front frame 600 is fixed in position with respect to main frame 402 by the left hand side support latch arm 432 and is secured on the right hand side by mounting plate 434 (FIG. 16). The support latch arm 432 can be detached at the left hand side and swung upwardly as shown in FIG. 18. The detachment bolts or fasteners 604 and 606 can be conveniently removed for this purpose. The support latch arm 432 is secured by a support arm bushing 608 which provides for pivotal movement about a pivot pin 610. The front roller drum 436 is rotatably secured at the front end of frame 600 by an axle 612.

Figure 19:
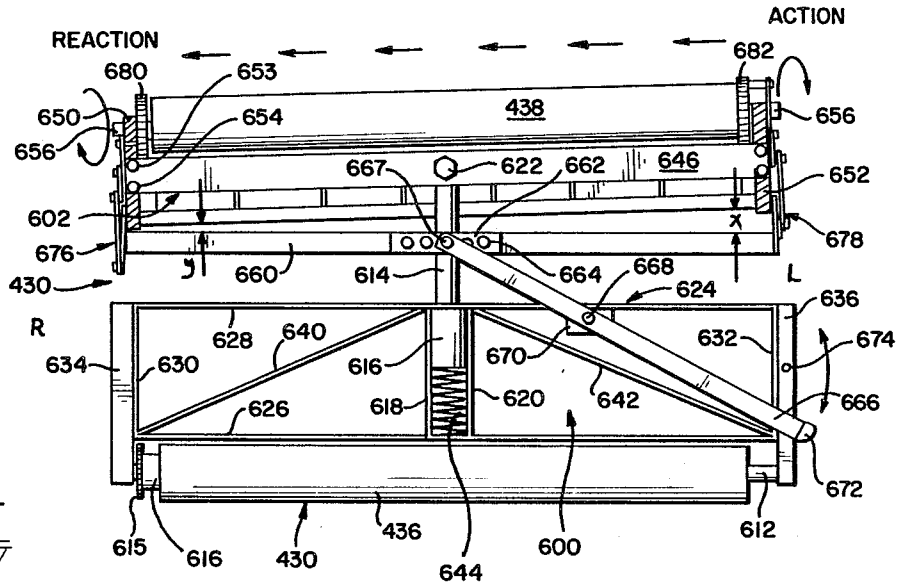
FIG. 19 is a top plan view of the grout pick-up assembly of the present invention without the grout removal belt.

The rear frame 602 is designed to be an adjustable or floating frame which is connected to the front frame 600 by a king pin 614. King pin 614 is flexibly connected within a support tube 616 which is secured within front frame 600 by mounting plates 618 and 620 (FIG. 19). The king pin 614 is pivotally connected to the rear frame 602 through a pivot bolt 622. The rear frame 602 is also "connected" to the front frame 600 by the grout take-up belt 440 during the use of grouting machine 400.

The front frame 600 is constructed with a base frame 624 which is formed by a front plate 626 and a rear plate 628 and side frame plates 630 on the right hand side and 632 on the left hand side. Outer mounting bars 634 and 636 are also provided for and are secured to the right and left hand side frame members 630 and 632, respectively, and extend forward to provide the mounting for the front roller drum axle 612. A sprocket gear 615 is fixedly mounted to axle 612 at the right hand side as shown in FIG. 19. A spacer member 616 is provided to center the front roller drum 436 with respect to the front frame 600. The mounting plates 618 and 620 are centered within the front frame 600 as shown in FIG. 19 and form part of the structural support within the frame. Diagonal frame members 640 and 642 are also provided to increase structural rigidity.

A coil spring 644 is provided between the front plate 626 and the front end of king pin 614 and is retained within the frame 600 by the support tube 616. Thus the king pin 614 is pushed axially rearward toward the rear frame 602 by coil spring 614.

The rear frame 602 is formed by an upper and lower cross brace 646 and 648 as shown by FIGS. 18 and 19 and a right hand side mounting plate 650 and a corresponding left hand mounting plate 652. The upper and lower braces are secured to the mounting plates 650 and 652 by bolts or other fasteners as illustrated by fasteners 653 and 654 (FIG. 19). As stated above the king pin 614 is pivotally connected to the rear frame 602 by the pivot bolt 622. This bolt is retained by the upper and lower cross braces 646 and 648 as shown in FIG. 19.

At the rear portion of side mounting plates 650 and 652 the rear roller drum 638 is secured by a rotatably mounted axle 656.

GROUT PICK-UP ASSEMBLY ADJUSTMENT

The grout pick-up assembly 430 is provided with an adjustable or flexible rear frame 602 by several means. The first among these is the provision of a transverse yoke 660 which is perpendicularly connected to king pin 614 by a top collar 662. A series of four connector bolts illustrated by bolt 644 secure the collar 662 over the king pin 614. A bolt change lever lever 666 is also provided as shown in FIGS. 18 and 19 (but omitted from FIG. 14). The belt change lever 666 is pivotally secured by mounting bolt 667 at its rear end to the collar 662 and is pivotally secured by a mounting bolt 668 near its mid-portion as shown in FIG. 19. A mounting stud 670 is provided for mounting the bolt 668. This plate is secured to the inner surface of rear wall 628 of the front 600. A downturned end 672 is provided on the left hand side as shown in FIGS. 18 and 19 to permit safe use. Also a removable catch 674 is provided at the left hand side in the mounting plate 636. The right hand end of the cross yoke 660 is pivotally connected to a right hand adjustment linkage system 676 and the left hand end of the yoke 660 is connected to a left hand linkage system 678 each of which are also connected to the side braces 650 and 656, respectively, or the rear frame 602.

A first adjustment feature provided by the above described yoke 660 and belt change lever 666 is that for changing the belt 440 the belt change lever is moved rearward and secured by the catch 672. The movement of the belt change lever 666 rearward at its downturned end 672 pivots the lever about the mounting bolt 668 and forces the king pin 614 into the rear end of the mounting tube 616 which then compresses the coil spring 644 so that the distance between the front frame 600 and the rear frame 602 is decreased. This decrease in distance permits an easy removal of belt 440 out from the left hand side of grouting machine 400. The above elements 614, 644, 666, 668, and 672 form an adjustable belt removal means.

The connection of the cross yoke 660 by either end thereof to the right hand side linkage system 676 and the left hand linkage 678 also permits the movement of the rear frame 602 relative to the yoke so that the distance between the rear frame 602 and the yoke 660 can vary depending on the use conditions encountered by the grouting machine 400 and specifically by the grout pick-up assembly 430.

The variable distance between the right and left hand sides of the rear frame 602 and yoke 660 is shown in FIG. 19 by dimension y on the right hand side (R) and dimension x on the left hand side (L) as viewed in the forward facing direction of grouting machine 400. Thus the rear frame 602 pivots about the pivot bolt 622 in a manner which permits the grout take-up belt 440 to remain in position about the front roller drum 436 and the rear roller drum 438. This adjustment action will be further described below.

The adjustment action permitted by the pivoting of the rear assembly frame 602 about pivot pin 622 which controls the variable distances x and y is actuated through the linkage systems 676 and 678 on the left hand side. These linkage systems are actuated by the actuator disk 680 on the right hand side and 682 on the left hand side which are rotatably or loosely mounted on the rear roller drum axle 656.

Figure 25:
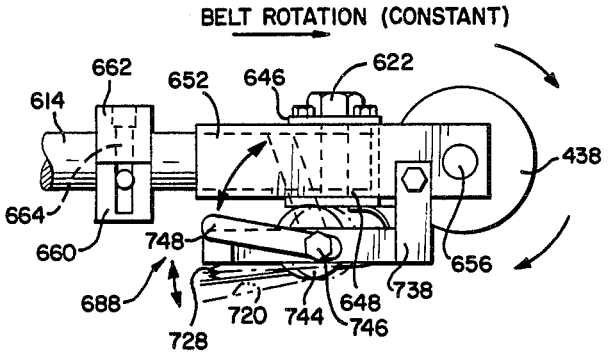
FIG. 25 is a detailed view of the rear portion of the grout pick-up assembly showing both the rear roller drum and the belt depressor assembly.
Figure 26:
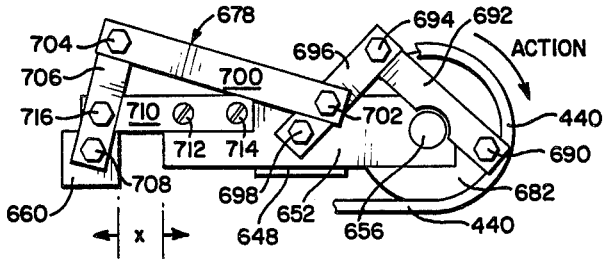
FIG. 26 is a side detailed view of the grout pick-up assembly in the fully activated position.

The rear roller drum 438 is shown in FIG. 25 without the left hand side linkage system 678. In this FIG. 25 the king pin 614 is shown in relation to the underslung yoke 660 and the left side mounting plate 652 and the upper cross brace 646 and the lower cross brace 648. The pivot pin 622 is also shown in this side view. The top collar 662 is shown clamping the king pin 614 by means of connector bolt 664. A mounting hole 684 is provided in the end of yoke 660 for mounting the pivot bolt 708 (FIG. 26). A similar mounting hole is provided in the opposite right hand end of yoke 660 for mounting a pivot bolt for the right hand side linkage system 676.

Also shown in FIG. 25 is the belt depressor mechanism 688 which will be further described below.

In FIG. 26 the same left side view as taken in FIG. 25 is shown with the left hand actuator disk 682 in place behind the rearmost end of the side frame member 652. Also shown is the actuator linkage system 678 which is connected by a pivot bolt 690 to the actuator disk 682. the actuator linkage is composed of a first linkage 692 which extends upwardly beyond the circumference of the actuator disk 682 and is pivotally joined by a bolt 694 to a second linkage 696 which is in turn pivotally connected by pivot bolt 698 to the side frame member 652. A third linkage member 700 is connected to a mid-portion of linkage 696 by a pivot bolt 702. The opposite end of the third linkage 700 is pivotally connected by a pivot bolt 704 to a fourth linkage member 706 which has its opposite end pivotally connected to a pivot bolt 708 which connects the linkage 706 to the left end of yoke 660. The fourth link 706 is pivotally connected at an intermediate position to an extension member 710 which is fastened to the front end portion of the side mounting plate 652 via screws 712 and 714. A pivot bolt 716 is connected between the link 706 and the extension member 710. The variable distance x is shown between the front edge of the side mounting plate 652 and the rear edge of yoke 660.

In operation, the motion of the belt 440 around the periphery of the rear roller drum 438 will encounter the actuator disk 682 if it drifts to the left of the grout pick-up assembly 430. When the belt rotating in a clockwise direction as seen in FIG. 26 encounters the actuator disk 682 the disk will be rotated also in a clockwise direction and the linkage pattern will come to rest in the position shown in FIG. 26. This will result in the dimension x being at its maximum. The result of this adjustment action is that the distance between the yoke 660 and the rear roller drum 656 will be increased in order to tighten the belt 440 about the grout take-up assembly 430. This will at the same time permit the right hand distance y to decrease which will then cause the belt to tend to float or drift toward the right hand side.

A similar linkage system 676 (FIG. 19) is provided on the right hand side of the rear frame 602 so that the same type of action for increasing the distance y is available on the right side of the rear frame 602 with respect to the yoke 660. In this manner the rear frame 602 is capable of moving backward along the left hand side and forward along the right hand side or the opposite pattern of rearward along the right hand side and forward along the left hand side so that the belt 440 is in a continual state of dynamic repositioning toward the center axis of the grout pick-up assembly 430 and the grouting machine 400. In the position shown in FIG. 26 the actuator disk 682 has been fully activated so that the distance x has been maximized. In this configuration the first link 692 rests on the extended axle 656 of the rear roller drum 438 (not seen in FIG. 26, but in FIG. 25).

Figure 27:
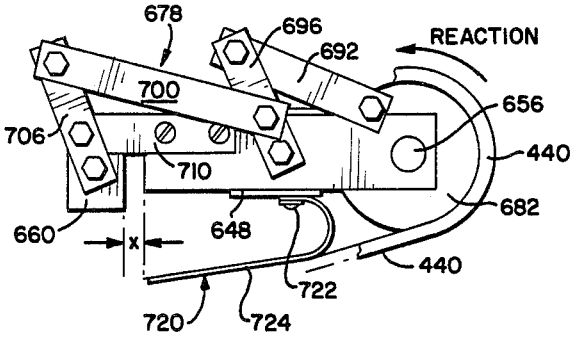
FIG. 27 is a side detailed view of the rear portion of the grout pick-up assembly and the non-activated position.

In FIG. 27 the linkage system 678 is shown in its inactivated position in which the first link 692 is extended forward to its maximum position which then causes the dimension x to be at its minimum. When the grout take-up belt 440 drifts toward the left hand side of the grout pick-up assembly r30 the belt edge encounters the actuator disk 682 and rotates it in a clockwise position as described above with respect to FIG. 26. This causes the dimension x to increase and at some point of increasing the dimension x the belt 440 will be tightened around the rear roller drum 438 sufficiently to inhibit the leftward drift of the belt and the belt will then tend to drift toward the right hand side of the grout take-up assembly and drifting toward the right hand side will then encounter the right hand actuator disk 680 and the linkage system 676 will then activate to increase the dimension y in a fashion similar to that explained with respect to FIGS. 26 and 27 for dimension x. Thus the "seesaw" action of the rear frame member 602 will function to keep the belt 440 operating within the center of the grout take-up assembly 430 by a dynamic positioning action. The cross yoke 660 and the linkage systems 676 and 678 thus form dynamic positioning or centering means for the belt 440.

BELT DEPRESSOR MECHANISM

FIG. 27 also shows one of the belt depressor shoes 720 connected to the underside of the cross brace 648 by a connector means 722. As the belt 440 comes off the external periphery of the rear roller drum 438 it is contacted by the undershoe portion 724 of the belt depressor shoe 720 which then tends to force the belt 440 into contact with the tile upper surfaces 456 (FIG. 14).

Figure 28:
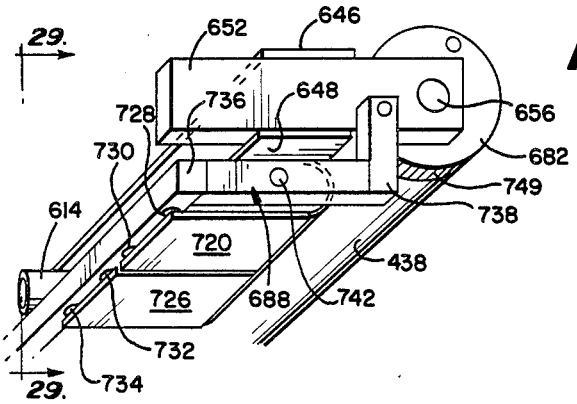
FIG. 28 is a perspective view of the rear portion of the grout pick-up assembly of the machine shown in FIG. 14 in which the belt depression mechanism can be seen.

The depressor shoe 720 is one of a series of shoes similarly mounted on the undersurface of cross brace 648 as shown in FIG. 28 wherein a second depressor shoe 726 is shown. The plurality of depressor shoes 720, 726, etc. are pushed downwardly against the inner side of belt 440 by a series of coil springs illustrated by coil spring 728 (FIG. 25). Two coil springs are provided for each of the depressor shoes and are retained in retainer holes shown as 728 and 730 for depressor shoe 720 in FIG. 28 and as retainer holes 732 and 734 for depressor shoe 726. The retainer holes are formed in a depressor member 736 which is mounted on either side of the rear frame 602 by L arms 738 and 740 (FIG. 16). A cam pin opening 742 is provided in L member 738 and a similar opening is provided on the right hand side L member 740 (not shown). An off-center cam member 744 is rotatably mounted by a cam pin 746 in the cam pin hole 742 and a cam adjustment lever 748 is connected to the pin 746. A lock washer arrangement is provided to retain the cam member 744 remain in position once adjusted by the lever 748. A similar cam member and adjustment lever are provided on the right hand side opposite the cam adjustment member shown in FIG. 25. The cam pin 746 can be designed to stand across and interconnect the two L members 738 and 740 or can be independent of one another in order to provide for a slight adjustment of depression pressure against the right and the left hand side of the belt 440 against the tile upper surface 456. The adjustment of the eccentric cam member 744 adjusts the L arm 738 downwardly and presses spring 728 against the depressor shoe element 724 as shown in FIG. 25. The lower position of the belt depressor shoe element 720 is shown in phantom lines in FIG. 25. Thus the series of belt depressor shoes represented by elements 720 and 726 in FIG. 28 provide an adjustable downward pressure against the inside of belt 440 in order to force the outer surface thereof into contact with the upper tile surface 456 as shown in FIG. 1.

FIG. 28 shows that the actuator disks illustrated by disk 682 can have a serrated of knourled peripheral surface 749 to improve contact with the belt 440.

As shown in FIG. 29 the series of belt depressor shoe elements 750, 752, 754 and 756 extend across the entire width of the rear frame 602 and are uniformly secured to the undersurface of the lower cross frame member 648. A series of coil springs are retained by the cross retention member 736 and exert downward pressure on the outer front portions of the depressor elements 750-756. The coil springs are shown as springs 758-772 in FIG. 29. The bottom view of the grouting machine 400 seen in FIG. 16 also shows the belt depressor shoe elements 720, 726, 750, 752, 754, 756, and 774. FIG. 16 is shown without the belt 440 for purpose of showing the number and positioning of the belt depressor shoe elements.

LATERAL "FLOATING" ADJUSTMENT

FIG. 22 illustrates another degree of freedom for the rear frame 602 of the grout pick-up assembly 430. The connection of the front frame 600 to the rear frame 602 is through the king pin 614 which is retained within the tube housing 616 as shown in FIG. 19. The connection is thus rotatable along the axis of the king pin. Thus the rear frame and the rear roller drum 438 is axially adjustable around the king pin axis. This motion is a lateral "floating" degree of freedom which permits the rear roller axle 656 to adjust over an angle A as shown in FIG. 22. This adjustment permits the rear roller to accommodate to different surface heights in order to better conform to irregular tile upper surfaces. FIG. 22 is shown without the grout removal belt on the right hand side and with the grout removal belt 440 on the left hand side of the rear roller drum 438. Other structural elements identified above are shown in this schematic view as well.

FLOOR GASKET REPLACEMENT

FIG. 24 shows a detailed view of the front portion of the grout hopper frame containing frame members 500 and 502. A gasket retainer bracket 780 is integrally affixed to the front portion of the front lower cross brace 502 and is provided with a pivotal retainer bar 782 at the lower end thereof by a pivot pin 784 connector. The tubular floor gasket 524 is retained by the retainer bar 782 by positioning the tube over the retainer bar when the retainer bar is parallel with the floor surface. For removal of and replacement of the floor gasket tube 524 the gasket can be pulled away from the machine from the underside and a new gasket put on by slowly allowing the bar 782 to slide into the tube 524.

GROUT REMOVAL MEANS

The grout removal means of the grouting machines 20 and 400 comprise grout or slurry pick-up assemblies which are operatively affixed to the underside of the grouting machines 20 and 400. The pick-up assemblies or means are the slurry pick-up assemblies 176 and 178 which include pick-up rollers 180 and 270 of grouting machine 20 or the grout pick-up assembly 430 of machine 400 which includes belt 440. These elements function as slurry pick-up or more broadly as grout removal means. The grout or slurry pick-up rollers or belt are powered by main drive motors through a sprocket gear and sprocket chain power transmission arrangement from drive motors. If desired, other power transmission mechanisms can of course be employed.

In the case of grouting machine 20 the grout hopper 38 is vibrated by a mechanism 224 in which case the grout is evenly distributed into the spaces between the tile as the machine passes over the pattern of laid tiles. In this case of grouting machine 400 the paddle wheel 452 is provided to physically push the grout into the positioned floor tiles. These elements form the grout dispensing means.

The grout or slurry take-up assembly 440 is provided with a dynamic belt positioning system which involves the use of a cross yoke 660 and side mounted dynamic linkage systems 676 and 678 which operate from actuator disks 680 and 682, respectively. The rear frame 602 of the belt retaining slurry or grout pick-up assembly 430 has two degrees of freedom of movement in normal usage and a third degree of movement for removing the belt by operation of the belt change lever 666. Thus three degrees of freedom are provided within the slurry or grout pick-up assembly 430.

The belt depressor system 688 operates as a belt tensioning means which uniformly tensions the belt 440. The actuator disks 680 and 682 and the interconnected linkage systems 676 and 678, respectively, function as dynamic belt positioning or centering means and also provide for nonuniform belt tensioning and are thus nonuniform belt tensioning means. Thus both nonuniform and uniform belt tensioning means are provided by the grout or slurry pick-up assembly 430. The spray bar 162 and nozzles 166 of machine 20 and the diluent addition means 454 of machine 400 both function as slurry formation or diluent addition means. The diluent can contact the grout when on the tile surfaces and/or when on the rollers 180 and 270 or belt 440.

The power from the gear motor 442 is transmitted via output shaft 790 to an outer sprocket gear 792 and then rotary motion is transmitted to a sprocket chain down the right hand side of machine 400 in order to transmit mechanical power into the front roller drive gear 615 as shown in FIGS. 15 and 16. An intermediate pinion gear 794 transmits power to a second pinion gear 796 and then through the connector shaft 798 into the sprocket gear 446 as shown in FIG. 15. Thus the gear motor 442 in FIG. 15 operates the front roller drum 436 as shown in FIGS. 16 and 19 in order to rotate the belt 440 in a clockwise direction around the front roller drum as seen in FIG. 14. Thus the belt 440 is being rotated in a frontward direction as seen from the handle 474 and the grouting machine 400 is being pulled in the front direction at the same time thus the belt 440 has a speed of contact slightly greater than the motion of the belt around the driven front roller drum 436 when the machine is in use.

FIG. 30 shows a cross section of the belt 440 which is formed with a high density polymeric foam outer layer 800 which is integrally fixed to a woven synthetic fabric reinforcement layer 802. The woven fabric layer 802 can be a water resistant polyester canvas and provides the function of reinforcing the outer layer 800. This fabric layer 802 contacts the front and rear roller drums 436 and 438. The outer layer 800 can be glued to the fabric layer 802 as illustrated by glue layer 804. A suitable belt material of this description is manufactured by the Olin Corporation under the trade name OMALON, a registered trademark, and is produced under U.S. Pat. No. 3,506,600.

The spray nozzles 166 of grouting machine 20 and the nozzles 556 of grouting machine 400 can be any of a wide range of such spray nozzles.

Suitable nozzles can be obtained from agricultural chemical suppliers under the name L P TeeJet, a registered trademark of TeeJet, Inc., for spray nozzles with flat spray tips. These are further described in U.S. Pat. No. 3,858,812.

The above descriptions and modifications of the invention are to be understood as illustrative and not limiting with respect to any other modification or embodiment which is covered by the scope hereof as defined by the following claims.

What is claimed and desired to be secured by Letters Patent is:

1. A grouting machine for applying grout to positioned floor tiles comprising:

a. support means, b. grout dispensing means operatively connected to said support means and adapted for depositing grout into spaces between the tiles and on the tile upper surfaces, c. slurry formation means operatively connected to said support means contiguously with respect to said dispensing means, said slurry formation means including a diluent addition means adapted for supplying a grout diluent to the grout remaining on the tile upper surfaces to form a slurry therewith, d. slurry pick-up means operatively connected to said support means contiguously with respect to said formation means and adapted for removing slurry from the tile upper surfaces.

2. A grouting machine according to claim 1 wherein said slurry pick-up means comprises at least one slurry take up roller and a perforated slurry intake tube positioned contiguous to said take-up roller.

3. A grouting machine according to claim 2, wherein a driven roller is positioned within said machine for contacting and driving said take-up roller.

4. A grouting machine according to claim 3, wherein said take-up roller is driven in the opposite direction to the direction of travel of said machine relative to the tiles being grouted.

5. A grouting machine according to claim 2, wherein said slurry intake tube is connected to an air evacuating means,

6. A grouting machine according to claim 5, wherein a slurry separator system is provided within said machine for separating excess diluent from the slurry taken up by said slurry intake tube.

7. A grouting machine according to claim 6, wherein said slurry separator system is adapted to supply grout diluent to said slurry formation means.

8. A grouting machine according to claim 1, wherein wiper means is associated with said grout dispensing means for wiping excess grout from the upper surface of the tiles.

9. A grouting machine according to claim 1, wherein a vibrator means is connected to said grout dispensing means and is adapted to impart vibrating motion to said dispensing means.

10. A grouting machine according to claim 2, wherein said perforated slurry intake tube of said pick-up means is positioned in frictional contact with said take-up roller and wherein a drive roller is positioned in frictional driving contact with said slurry take-up roller.

11. a grouting machine according to claim 10, wherein said perforated slurry intake tube of said pick-up means is journaled for rotation about the longitudinal axis thereof.

12. A grouting machine according to claim 2, wherein an air evacuating means is connected to the two ends of said slurry intake tube.

13. A grouting machine according to claim 12, wherein an airtight rotary connections are coupled to the two ends of said slurry intake tube and to said air evacuating means.

14. A grouting machine according to claim 10, wherein said slurry pick-up means is pivotably mounted about a pivot axis on the underside of said machine and wherein said slurry take-up roller is adapted for contacting the upper surfaces of the floor tiles and for wiping the grout slurry upward therefrom.

15. A grouting machine according to claim 10, wherein said pick-up means is spring biased with respect to said machine about said pivot axis in the direction of movement of said machine during grouting.

16. A grouting machine according to claim 2, wherein two slurry pick-up means are provided for said machine.

17. A grouting machine according to claim 16, wherein both of said pick-up means are pivotally mounted about two separated pivot axes and are spring biased in the direction of movement of said machine during grouting.

18. A grouting machine according to claim 1, wherein a plurality of caster wheels are connected to the underside of said machine in spaced relation to each other.

19. A grouting machine according to claim 1, wherein a pivotal set of caster wheels are attached to the front portion of said machine and are adapted for contact with a floor surface for moving said machine into grouting position.

20. A grouting machine according to claim 9, wherein a suspension frame is connected to said grout dispensing means and wherein said vibrator means is mounted to said suspension frame.

21. A grouting machine according to claim 9, wherein a drive motor is provided for supplying mechanical energy to said vibrator means and wherein energy to said vibrator means and wherein said vibrator means includes a sheave and eccentric weight vibrator element.

22. A grouting machine according to claim 20, wherein a frame system is provided for said machine and wherein said suspension frame is suspended from said frame system by motion absorbing elements arranged in first and second planes.

23. A grouting machine according to claim 22, wherein said first and second planes are arranged perpendicularly with respect to each other.

24. A grouting machine for applying grout to positioned floor tiles comprising:

support means, grout dispensing means operatively connected to said support means at a first position and adapted for depositing grout between the tiles and on the tile upper surfaces, and removal means operatively connected to said support means at a second position and, said removal means including a power driven wiping element adapted to move across the tile upper surfaces in a manner different from the movement of said machine for removing excess grout from the tile upper surfaces 25. A grouting machine according to claim 24, wherein grout is composed of particulate material suspended in a diluent and wherein a slurry formation means is provided for adding a diluent to the deposited grout to form a slurry on the tile upper surfaces.

26. A grouting machine according to claim 24, wherein said removal means comprises:

a slurry take-up roller adapted for rotary motion about its longitudinal action and adapted for wiping grout slurry away from the upper surfaces of the tiles, a perforated slurry intake tube positioned in frictional contact with said take-up roller and adapted to be rotated thereby, and an air evacuating means connected to said slurry intake tube and adapted for conducting air and grout slurry through the perforation of said intake tube and through said intake tube.

27. A grouting machine according to claim 26, wherein said removal means comprises a driven roller positioned in frictional contact with said slurry take-up roller and adapted to rotate said take-up roller.

28. A grouting machine according to claim 27, wherein a drive motor is provided on said machine and is adapted for providing mechanical power to rotate said drive roller.

29. A grouting machine according to claim 26, wherein a slurry storage tank is provided for deposit of slurry conducted through said air evacuating means and wherein a vacuum pump is operably connected to the head space within said storage tank and is adapted for removing air therefrom.

30. A grouting machine according to claim 25, wherein said removal means comprises at least two slurry pick-up means each having a slurry take-up roller, and a perforated slurry intake tube.

31. A grouting machine according to claim 29, wherein a drive motor is provided on said machine and is adapted for providing mechanical power to rotate said drive roller and wherein the air exhaust line from said vacuum pump is operatively connected to supply cooling air to said drive motor.

32. A grouting machine for applying grout to positioned floor tiles comprising:

support means, grout dispensing means operatively connected to said support means at a first position and adapted for depositing grout between the tiles and on the upper surfaces of the tiles, said dispensing means having front and rear wipers and side positioned runners adapted for confining the application of grout to a defined pathway, and removal means operatively connected to said support means at a second position and, said removal means including a power driven wiping element adapted to move across the tile upper surfaces in a manner different from the movement of said machine for removing excess grout from the upper surfaces.

33. A grouting machine according to claim 32, wherein side wiper shoes are positioned and inwardly directed angle immediately to the rear of said dispensing means and are adapted to wipe any grout which oozed beyond said defined pathway back into the pathway.

34. A grouting machine according to claim 32, wherein said rear wiper is adapted for feeding downwardly as it is worn away by abrasion against the grout and tiles.

35. A grouting machine according to claim 32, wherein a front wheel set is pivotally mounted on the front portion of said machine and is adapted to be pivoted out of contact with a floor during grouting to provide intimate contact of said front and rear wipers and said side runners with the upper surfaces of the tiles.

36. A grouting machine according to claim 32, wherein said removal means comprises a slurry formation means for adding a diluent to the grout dispensed from said dispensing means and a slurry separator means for removing excess diluent from the said slurry.

37. A grouting machine according to claim 36, wherein said slurry separator means comprises a slurry storage tank and a filter means for retaining the particulate matter in the slurry and passing through the diluent.

38. A grouting machine according to claim 36, wherein diluent removed from the slurry is recycled for use through said slurry formation means.

39. A grouting machine according to claim 36, wherein said slurry formation means comprises a diluent spray tube located between said grout dispensing means and said removal means.

40. A grouting machine according to claim 32, wherein a pull handle is attached to the front portion thereof for manually moving said machine forward over the positioned floor tiles.

41. A grouting machine for applying grout to positioned floor tiles comprising:

a. grout dispensing means adapted for depositing grout into spaces between the tiles and on the tile upper surfaces, b. diluent addition means operatively connected to said grout dispensing means and adapted for supplying a grout diluent to the grout remaining on the tile upper surfaces to form a slurry therewith, and c. grout pick-up means operatively connected to said grout dispensing means and adapted for removing slurry from the tile upper surfaces.

42. A grouting machine machine according to claim 41, wherein said grout pick-up means includes a continuous belt which is adapted in power driven contact with the said positioned floor tiles.

43. A grouting machine according to claim 42, wherein said continuous belt is driven in a forward direction with respect the motion of said grouting machine with respect to said positioned floor tiles.

44. A grouting machine according to claim 41, wherein said grout pick-up means comprises at least one slurry take-up roller.

45. A grouting machine according to claim 44, wherein said grout pick-up means comprises two slurry take-up rollers.

46. A grout machine according to claim 42, wherein said grouting pick-up means includes a belt centering means.

47. A grouting machine according to claim 42, wherein said grout pick-up means includes an adjustable belt removal means.

48. A grouting machine according to claim 41, wherein grout pick-up means comprises a rear roller drum frame which has at least two degrees of freedom of motion.

49. A grouting machine according to claim 41, wherein said grout dispensing means comprises a grout applying paddle wheel adapted for power driven rotation of a plurality of trowel blades.

50. A grouting machine according to claim 41, wherein said machine comprises a removable slurry tank adapted to contain grout slurry removed from the upper surfaces of said positioned floor tiles.

51. A grouting machine according to claim 41, wherein wiper means is associated with said grout dispensing means adapted for wiping excess grout from the upper surfaces of the tiles.

52. A grouting machine according to claim 41, wherein an air evacuating means is operatively connected to said grout pick-up means.

53. A grouting machine according to claim 52, wherein a grout intake means is connected to said air evacuating means.

54. A grouting machine according to claim 41 including a belt depressor means.

55. A grouting machine according to claim 54, wherein said belt depressor means is adapted for adjustments in depression pressure.

56. A grouting machine for applying grout to positioned floor tiles comprising:

a. support means, b. grout dispensing means operatively connected to said support means at a first position and adapted for depositing grout between the tiles and on the tile upper surfaces, and c. removal means operatively connected to said support means at a second position and, said removal means including a power driven wiping element adapted to move across the tile upper surfaces in a manner different from the movement of said machine for removing excess grout from the tile upper surfaces.

57. A grouting machine machine according to claim 56, wherein said removal means includes a continuous belt which is adapted for power driven contact with said positioned floor tiles.

58. A grouting machine according to claim 57, wherein said grout pick-up means includes a belt centering means.

59. A grouting machine according to claim 56, wherein said removal means comprises a rear roller drum frame which has at least two degrees of freedom of motion.

60. A grouting machine according to claim 56, wherein said removal means comprises a grout applying paddle wheel adapted for power driven rotation of a plurality of trowel blades.

61. A grouting machine according to claim 56, wherein a wiper means is associated with said grout dispensing means and is adapted for wiping excess grout from the upper surfaces of the tiles.

62. A grouting machine according to claim 56, wherein an air evacuating means is operatively connected to said grout pick-up means.

63. A grouting machine according to claim 56 including a belt depressor means.

64. A grouting machine for applying grout to positioned floor tiles comprising:

grout dispensing means adapted for depositing grout between the tiles and on the upper surfaces of the tiles, said dispensing means having rear wipers and side positioned runners adapted for confining the application of grout to a defined pathway, and removal means operatively connected to said grout dispensing means and, said removal means including a power driven wiping element adapted to move across the tile upper surfaces in a manner different from the movement of said machine for removing excess grout from the tile upper surfaces.

65. A grouting machine machine according to claim 64, wherein said removal means includes a continuous belt which is adapted in power driven contact with said positioned floor tiles.

66. A grouting machine according to claim 65, wherein said grout pick-up means includes a belt centering means.

67. A grouting machine according to claim 64, wherein removal means comprises a rear roller drum frame which has at least two degrees of freedom of motion.

68. A grouting machine according to claim 64, wherein said removal means comprises a grout applying paddle wheel adapted for power driven rotation of a plurality of trowel blades.

69. A grouting machine according to claim 64, wherein an air evacuating means is operatively connected to said grout pick-up means.

70. A grouting machine according to claim 64 including a belt depressor means.

* * * * *